US011776714B2

(12) United States Patent
Chun

(10) Patent No.: US 11,776,714 B2
(45) Date of Patent: Oct. 3, 2023

(54) DEVICE FOR COATING A WIRE WITH POLYMER FIBERS AND METHOD THEREOF

(71) Applicant: E-Wireligner Co., Ltd., Seoul (KR)

(72) Inventor: Youn Sic Chun, Seoul (KR)

(73) Assignee: E-WIRELIGNER CO., LTD., Seoul (KR)

( * ) Notice: Subject to any disclaimer, the term of this patent is extended or adjusted under 35 U.S.C. 154(b) by 153 days.

(21) Appl. No.: 17/158,153

(22) Filed: Jan. 26, 2021

(65) Prior Publication Data

US 2022/0157496 A1 May 19, 2022

(30) Foreign Application Priority Data

Nov. 13, 2020 (KR) ..... 10-2020-0152107
Nov. 13, 2020 (KR) ..... 10-2020-0152108

(51) Int. Cl.
*H01B 13/06* (2006.01)
*B05C 5/02* (2006.01)
(Continued)

(52) U.S. Cl.
CPC ..... *H01B 13/06* (2013.01); *B05C 5/0241* (2013.01); *B05D 3/002* (2013.01); *B05D 7/20* (2013.01);
(Continued)

(58) Field of Classification Search
CPC ..... D01D 5/0076; D01D 5/00; D01D 5/38; D01D 10/04; D01D 7/00; D01B 7/14;
(Continued)

(56) References Cited

U.S. PATENT DOCUMENTS 3,227,577 A * 1/1966 Baessler ..... C23C 2/36 118/69
4,004,999 A * 1/1977 Shibayama ..... H01B 13/06 204/507
(Continued)

FOREIGN PATENT DOCUMENTS

CN 104032423 9/2014
CN 105839253 8/2016
(Continued)

OTHER PUBLICATIONS

Merriam-Webster.com "wrinkle" definition, 2023, p. 1. (Year: 2023).*
(Continued)

*Primary Examiner* — Karl Kurple
(74) *Attorney, Agent, or Firm* — CANTOR COLBURN LLP

(57) ABSTRACT

A device for coating a wire with polymer fibers and method thereof are provided. The device includes a wire holder unit fixing both ends of a wire, a fiber forming unit including a first fiber forming module and a second fiber forming module that receive a polymer solution, face each other, and form fibers while approaching each other and retreating from each other, and a control unit adjusting a tension of the wire by controlling the wire holder unit and crossing the wire and the fibers by controlling the fiber forming unit. The fiber forming unit rotates the wire along an axis which extends in a longitudinal direction of the wire. The fibers are attached and coated on the wire when the wire and the fibers cross each other. The wire coating method can improve an adsorption state of coated fibers by including a post-processing step.

11 Claims, 18 Drawing Sheets

(51) Int. Cl.

| | |
|---|---|
| ***B05D 7/20*** | (2006.01) |
| ***H01B 13/30*** | (2006.01) |
| ***H01B 3/44*** | (2006.01) |
| ***H01B 13/00*** | (2006.01) |
| ***B05D 3/00*** | (2006.01) |

(52) U.S. Cl.
CPC ..... *H01B 3/44* (2013.01); *H01B 13/0036* (2013.01); *H01B 13/30* (2013.01)

(58) Field of Classification Search
CPC .... B05C 5/0241; B05D 2256/00; B05D 7/20; H01B 13/30; H01B 13/06
USPC ..... 156/161, 229; 427/175, 207.1, 208.2, 427/208.4, 256, 422, 424, 427; 118/405, 118/419, 117, 304, 308, 325
See application file for complete search history.

(56) References Cited

U.S. PATENT DOCUMENTS 4,025,415 A * 5/1977 Shibayama ..... C25D 13/16 204/624
5,882,405 A * 3/1999 Kish ..... B05D 7/20 118/67
2005/0008771 A1* 1/2005 Goto ..... H01B 13/16 427/117
2010/0327494 A1* 12/2010 Jabbari ..... B29C 48/02 264/466
2011/0027458 A1* 2/2011 Boock ..... B05C 3/10 427/9
2019/0017194 A1* 1/2019 Rhee ..... D01D 5/00
2019/0322138 A1 10/2019 Kodama
2019/0352803 A1* 11/2019 Sharma ..... D02G 3/38

FOREIGN PATENT DOCUMENTS

JP 2001336076 12/2001
JP 2005105458 4/2005
JP 2015040363 3/2015
JP 6102876 3/2017
KR 19800001558 12/1980
KR 100636629 10/2006
KR 102055769 12/2019
WO 2018117124 6/2018
WO WO-2020013650 A1 * 1/2020 ..... D01D 5/00

OTHER PUBLICATIONS

Chinese Office Action—Chinese Application No. 202110125288.5 dated Dec. 28, 2022.
Korean Notice of Allowance—Korean Application No. 10-2020-0152107 dated Dec. 30, 2022.
Korean Notice of Allowance—Korean Application No. 10-2020-0152108 dated Dec. 30, 2022.

* cited by examiner

DEVICE FOR COATING A WIRE WITH POLYMER FIBERS AND METHOD THEREOF

TECHNICAL FIELD

The present disclosure relates to a wire coating device and method, and more particularly, to a wire coating device and method for forming polymer fibers from a polymer solution and coating the formed polymer fibers on a wire.

BACKGROUND

A wire coating device refers to a device that attaches and coats fine fibers on a wire. The existing wire coating device formed fibers from a polymer solution and coated the fibers on a wire by crossing the formed fibers on the wire.

According to the existing wire coating device, since a user must directly apply the polymer solution to a working surface, it may be difficult to secure reproducibility of the process. The existing wire coating device may cause inconvenience in that the user must directly insert ends of the wire into a gripping portion that grips both ends of the wire. Further, it may be difficult for the existing wire coating device to secure a state, in which the wire is pulled taut, and to know how much tension is formed on the wire.

A wire coating method refers to a method for attaching and coating fine fibers on a wire. For example, the wire coating method may use a wire coating device. Based on the wire coating method, the fibers may be coated on the wire.

The existing wire coating method may separate the coated wire from the device after coating the fibers on the wire and measure a thickness of the coated wire to evaluate quality of the coated wire. For example, if the thickness of the coated wire is less than a reference value, inefficiency of the wire coating process may occur because the coated wire must be coated again with the fibers.

(Patent document 1) KR 10-2055769 B1

SUMMARY

An object of the present disclosure is to address the above-described and other needs and/or problems.

Another object of the present disclosure is to provide a wire coating device and method for maintaining a state in which a wire is pulled taut in a process of coating fibers on the wire.

Another object of the present disclosure is to provide a wire coating device and method for measuring a thickness of a coated wire.

Another object of the present disclosure is to provide a wire coating device and method for guiding a wire to a chuck fixing the wire.

Another object of the present disclosure is to provide a wire coating device and method for fixing a wire to a chuck as a chuck, into which a wire is inserted, retracts into a chuck fixing the wire.

Another object of the present disclosure is to provide a wire coating device including a solution supply unit applying a polymer solution to a module forming polymer fibers.

Another object of the present disclosure is to provide a wire coating method including a pre-processing and a post-processing before and after a process of coating polymer fibers on a wire.

Another object of the present disclosure is to provide a wire coating method including a post-processing step for improving a state in which coated polymer fibers are adsorbed to a wire after coating the polymer fibers on the wire.

In order to achieve the above-described and other objects of the present disclosure, in one aspect, there is provided a wire coating device comprising a wire holder unit fixing both ends of a wire; a fiber forming unit including a first fiber forming module and a second fiber forming module that receive a polymer solution, face each other, and form fibers while approaching each other and retreating from each other; and a control unit configured to adjust a tension of the wire by controlling the wire holder unit and cross the wire and the fibers by controlling the fiber forming unit, wherein the fiber forming unit spins the wire about an axis of a longitudinal direction of the wire, wherein the fibers are attached and coated on the wire when the wire and the fibers cross each other.

In another aspect, there is provided a wire coating method comprising a pre-processing step of cleaning a wire and manufacturing a polymer solution before the wire is coated with polymer fibers; a wire coating step of forming the polymer fibers from the polymer solution and coating the formed polymer fibers on the wire; and a post-processing step of processing the coated wire.

Effects of the wire coating device and method according to the present disclosure are described as follows.

According to at least one aspect, the present disclosure can provide a wire coating device and method for maintaining a state in which a wire is pulled taut in a process of coating fibers on the wire.

According to at least one aspect, the present disclosure can provide a wire coating device and method for measuring a thickness of a coated wire.

According to at least one aspect, the present disclosure can provide a wire coating device and method for guiding a wire to a chuck fixing the wire.

According to at least one aspect, the present disclosure can provide a wire coating device and method for fixing a wire to a chuck as a chuck, into which a wire is inserted, retracts into a chuck fixing the wire.

According to at least one aspect, the present disclosure can provide a wire coating device including a solution supply unit applying a polymer solution to a module forming polymer fibers.

According to at least one aspect, the present disclosure can provide a wire coating method including a pre-processing and a post-processing before and after a process of coating polymer fibers on a wire.

According to at least one aspect, the present disclosure can a wire coating method including a post-processing step for improving a state in which coated polymer fibers are adsorbed to a wire after coating the polymer fibers on the wire.

Additional scope of applicability of the present disclosure will become apparent from the detailed description given blow. However, it should be understood that the detailed description and specific examples such as preferred embodiments of the present disclosure are given merely by way of example, since various changes and modifications within the spirit and scope of the present disclosure will become apparent to those skilled in the art from this detailed description.

BRIEF DESCRIPTION OF THE DRAWINGS

The accompanying drawings, which are included to provide a further understanding of the disclosure and are incorporated in and constitute a part of the disclosure, illustrate embodiments of the disclosure and together with the description serve to explain the principle of the disclosure.

DETAILED DESCRIPTION

Figure 1:
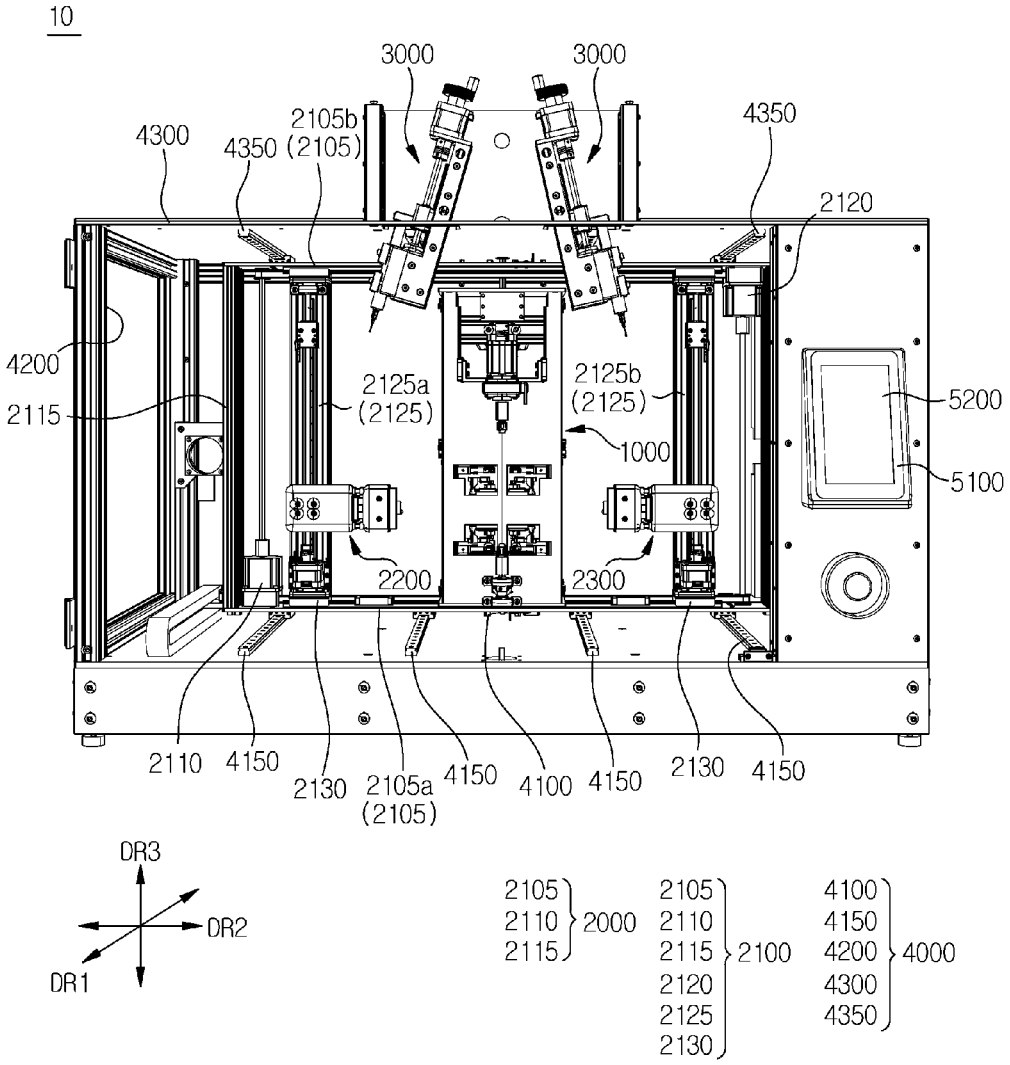
FIG. 1 illustrates a wire coating device 10 according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In general, a suffix such as "module" and "unit" may be used to refer to elements or components. Use of such a suffix herein is merely intended to facilitate description of the present disclosure, and the suffix itself is not intended to give any special meaning or function. It will be noted that a detailed description of known arts will be omitted if it is determined that the detailed description of the known arts can obscure the embodiments of the disclosure. The accompanying drawings are used to help easily understand various technical features and it should be understood that embodiments presented herein are not limited by the accompanying drawings. As such, the present disclosure should be construed to extend to any alterations, equivalents and substitutes in addition to those which are particularly set out in the accompanying drawings.

The terms including an ordinal number such as first, second, etc. may be used to describe various components, but the components are not limited by such terms. The terms are used only for the purpose of distinguishing one component from other components.

When any component is described as "being connected" or "being coupled" to other component, this should be understood to mean that another component may exist between them, although any component may be directly connected or coupled to the other component. In contrast, when any component is described as "being directly connected" or "being directly coupled" to other component, this should be understood to mean that no component exists between them.

A singular expression can include a plural expression as long as it does not have an apparently different meaning in context.

In the present disclosure, terms "include" and "have" should be understood to be intended to designate that illustrated features, numbers, steps, operations, components, parts or combinations thereof are present and not to preclude the existence of one or more different features, numbers, steps, operations, components, parts or combinations thereof, or the possibility of the addition thereof.

In the drawings, the sizes of the components may be exaggerated or reduced for convenience of explanation. For example, the size and the thickness of each component illustrated in the drawings are arbitrarily illustrated for convenience of explanation, and thus the present disclosure is not limited thereto unless specified as such.

If any embodiment is implementable differently, a specific order of processes may be performed differently from the order described. For example, two consecutively described processes may be performed substantially at the same time, or performed in the order opposite to the described order.

In the following embodiments, when layers, areas, components, etc. are connected, the following embodiments include both the case where layers, areas, and components are directly connected, and the case where layers, areas, and components are indirectly connected with other layers, areas, and components intervening between them. For example, when layers, areas, components, etc. are electrically connected, the present disclosure includes both the case where layers, areas, and components are directly electrically connected, and the case where layers, areas, and components are indirectly electrically connected with other layers, areas, and components intervening between them.

FIG. 1 illustrates a wire coating device 10 according to an embodiment of the present disclosure. The wire coating device 10 may cover or coat polymer fibers on a wire. The wire before the polymer fibers are covered or coated on the wire may be referred to as "wire core", and the wire after the polymer fibers are covered or coated may be referred to as "coated wire".

Referring to FIG. 1, the wire coating device 10 may include a casing unit 4000. The casing unit 4000 may form an accommodation space therein. In the accommodation space formed in the casing unit 4000, the polymer fibers may be covered or coated on the wire core.

The casing unit 4000 may include a bottom 4100. The bottom 4100 may form a horizon. The horizon may be defined by, for example, a first direction DR1 and a second direction DR2. The first direction DR1 may be, for example, a front-rear direction, and the second direction DR2 may be, for example, a left-right direction. A third direction DR3 may be perpendicular to the horizontal direction. The third direction DR3 may be, for example, an up-down direction. The components may be disposed on an upper surface of the bottom 4100.

The casing unit 4000 may include a bottom rail 4150. The bottom rail 4150 may be disposed on the upper surface of the bottom 4100. The bottom rail 4150 may be formed in a shape elongated in one direction. For example, the bottom rail 4150 may be formed in a shape elongated in the first direction DR1. The plurality of bottom rails 4150 may be provided. For example, the plurality of bottom rails 4150 may be disposed to be spaced apart from each other in the second direction DR2.

The casing unit 4000 may include a wall 4200. The wall 4200 may be formed in a shape extending upward from the bottom 4100. The wall 4200 may transmit at least a part of incident light. The interior of the casing unit 4000 may be observed from the outside through the wall 4200. A lower end of the wall 4200 may be connected to the bottom 4100.

The casing unit 4000 may include a ceiling 4300. The ceiling 4300 may be positioned on the bottom 4100. The ceiling 4300 may be connected to an upper end of the wall 4200.

The casing unit 4000 may include a ceiling rail 4350. The ceiling rail 4350 may be disposed on a lower surface of the ceiling 4300. The ceiling rail 4350 may be formed in a shape elongated in one direction. For example, the ceiling rail 4350 may be formed in a shape elongated in the first direction DR1. The plurality of ceiling rails 4350 may be provided. For example, the plurality of ceiling rails 4350 may be disposed to be spaced apart from each other in the second direction DR2. The ceiling rail 4350 may face the bottom rail 4150.

The wire coating device 10 may include a wire holder unit 1000. The wire holder unit 1000 may be installed in the casing unit 4000. For example, the wire holder unit 1000 may be positioned inside the casing unit 4000 and positioned between the bottom 4100 and the ceiling 4300.

At least a part of a lower surface of the wire holder unit 1000 may be positioned on the bottom 4100. In other words, at least a part of the lower surface of the wire holder unit 1000 may be spaced apart from the bottom 4100. At least a part of the lower surface of the wire holder unit 1000 may include a front portion of the lower surface of the wire holder unit 1000. In other words, when an object higher than a distance between the wire holder unit 1000 and the bottom 4100 moves from the front to the rear of the wire holder unit 1000, the object may be positioned between the wire holder unit 1000 and the bottom 4100.

The wire holder unit 1000 may be coupled to both ends of the wire core. The wire holder unit 1000 may form a tension between both ends of the wire core.

The wire coating device 10 may include a fiber forming unit 2000. The fiber forming unit 2000 may form fibers. The fibers may be produced from a polymer solution. A relative replacement between the fiber forming unit 2000 and the wire holder unit 1000 may vary. For example, the fiber forming unit 2000 may move with respect to the wire holder unit 1000. As another example, the wire holder unit 1000 may move with respect to the fiber forming unit 2000. In an embodiment of the present disclosure, the fiber forming unit 2000 may move with respect to the wire holder unit 1000, and in this process, the fibers may be covered or coated on the wire core.

The fiber forming unit 2000 may include a movement module 2100. The movement module 2100 may include a horizontal column 2105. The plurality of horizontal columns 2105 may be provided. For example, the horizontal column 2105 may include a bottom horizontal column 2105*a* and a ceiling horizontal column 2105*b*.

The bottom horizontal column 2105*a* may be positioned on the bottom rail 4150. For example, the bottom horizontal column 2105*a* may be formed in a shape elongated in the second direction DR2. The bottom horizontal column 2105*a* may move along the bottom rail 4150. For example, the bottom horizontal column 2105*a* may move in the first direction DR1.

The bottom horizontal column 2105*a* may be positioned in front of the wire holder unit 1000. When the bottom horizontal column 2105*a* moves backward, the bottom horizontal column 2105*a* may be positioned between the bottom 4100 and the wire holder unit 1000. When the bottom horizontal column 2105*a* moves forward, the bottom horizontal column 2105*a* may be positioned in front of the wire holder unit 1000.

The ceiling horizontal column 2105*b* may be positioned on the ceiling rail 4350. For example, the ceiling horizontal column 2105*b* may be formed in a shape elongated in the second direction DR2. The ceiling horizontal column 2105*b* may move along the ceiling rail 4350. For example, the ceiling horizontal column 2105*b* may move in the first direction DR1.

The movement module 2100 may include a vertical column 2115. The vertical column 2115 may connect the bottom horizontal column 2105*a* to the ceiling horizontal column 2105*b*. The plurality of vertical columns 2115 may be provided. For example, the vertical column 2115 may include a left vertical column 2115 and a right vertical column 2115.

The vertical column 2115, the bottom horizontal column 2105*a*, and the ceiling horizontal column 2105*b* may form a shape of a rectangular photo frame as a whole. The vertical column 2115, the bottom horizontal column 2105*a*, and the ceiling horizontal column 2105*b* may be referred to as "movement frames".

The movement frames 2105*a*, 2105*b* and 2115 may move in the front-rear direction. For example, the movement frames 2105*a*, 2105*b* and 2115 may move in the first direction DR1. The movement frames 2105*a*, 2105*b* and 2115 may move with respect to the wire holder unit 1000.

The movement frames 2105*a*, 2105*b* and 2115 may be positioned in front of the wire holder unit 1000. When the movement frames 2105*a*, 2105*b* and 2115 move rearward, the movement frames 2105*a*, 2105*b* and 2115 may form a shape surrounding the wire holder unit 1000. When the movement frames 2105*a*, 2105*b* and 2115 move forward, the movement frames 2105*a*, 2105*b* and 2115 may be positioned in front of the wire holder unit 1000.

The wire core and the fibers may cross each other while a relative replacement between the movement frames 2105*a*, 2105*b* and 2115 and the wire holder unit 1000 changes as above. In the process of crossing the wire core and the fibers, the fibers may be covered or coated on the wire core.

The movement module 2100 may include a vertical bar 2125. The vertical bar 2125 may be disposed between the bottom horizontal column 2105*a* and the ceiling horizontal column 2105*b*. For example, the vertical bar 2125 may connect the bottom horizontal column 2105*a* to the ceiling horizontal column 2105*b*. The vertical bar 2125 may extend from the bottom horizontal column 2105*a* and may be connected to the ceiling horizontal column 2105*b*.

The vertical bar 2125 may be positioned inside the movement frames 2105*a*, 2105*b* and 2115. The plurality of vertical bars 2125 may be provided. For example, the vertical bar 2125 may include a first vertical bar 2125*a* and a second vertical bar 2125*b*. The first vertical bar 2125*a* and the second vertical bar 2125*b* may be disposed in the second direction DR2 or the left-right direction.

The movement module 2100 may include a first direction movement module 2110. The first direction movement module 2110 may be installed in the movement frames 2105*a*, 2105*b* and 2115. The first direction movement module 2110 may move the movement frames 2105*a*, 2105*b* and 2115 in the first direction DR1 or the front-rear direction.

The movement module 2100 may include a second direction movement module 2120. The second direction movement module 2120 may be installed in the movement frames 2105*a*, 2105*b* and 2115. The second direction movement module 2120 may move the vertical bar 2125 in the second direction DR2 or the left-right direction. For example, the second direction movement module 2120 may allow the first vertical bar 2125*a* and the second vertical bar 2125*b* to be closer from each other or away from each other.

The movement module 2100 may include a third direction movement module 2130. The third direction movement module 2130 may be installed in the movement frames 2105*a*, 2105*b* and 2115. The third direction movement module 2130 may move fiber forming modules 2200 and 2300. The fiber forming modules 2200 and 2300 may move along the vertical bar 2125.

The fiber forming unit 2000 may include the fiber forming modules 2200 and 2300. The fiber forming modules 2200 and 2300 may include a first fiber forming module 2200 and a second fiber forming module 2300. The fiber forming modules 2200 and 2300 may indicate at least one of the first fiber forming module 2200 and the second fiber forming module 2300.

The first fiber forming module 2200 may be coupled to the first vertical bar 2125*a*. The first fiber forming module 2200 may move on the first vertical bar 2125*a*. For example, the first fiber forming module 2200 may go up and down on the first vertical bar 2125*a*.

The second fiber forming module 2300 may be coupled to the second vertical bar 2125*b*. The second fiber forming module 2300 may move on the second vertical bar 2125*b*. For example, the second fiber forming module 2300 may go up and down on the second vertical bar 2125*b*. The second fiber forming module 2300 may face the first fiber forming module 2200.

The third direction movement module 2130 may lift the fiber forming modules 2200 and 2300. That is, the fiber forming modules 2200 and 2300 may move up and down by means of the third direction movement module 2130. Even if the fiber forming modules 2200 and 2300 move up and down, the fiber forming modules 2200 and 2300 may face each other.

The second direction movement module 2120 may move the vertical bar 2125. For example, the vertical bar 2125 may move along the horizontal column 2105. When the first vertical bar 2125*a* and the second vertical bar 2125*b* approach each other, the first fiber forming module 2200 and the second fiber forming module 2300 may approach each other. When the first vertical bar 2125*a* and the second vertical bar 2125*b* are away from each other, the first fiber forming module 2200 and the second fiber forming module 2300 may be away from each other. When the first fiber forming module 2200 and the second fiber forming module 2300 are away from each other, the polymer solution positioned between the first fiber forming module 2200 and the second fiber forming module 2300 may be stretched. As the polymer solution is stretched, polymer fibers may be formed. The polymer fibers may extend from the first fiber forming module 2200 and lead to the second fiber forming module 2300.

The wire coating device 10 may include a solution supply unit 3000. The solution supply unit 3000 may accommodate a polymer solution. The solution supply unit 3000 may be installed in the casing unit 4000. The solution supply unit 3000 may provide the polymer solution to the fiber forming modules 2200 and 2300.

The wire coating device 10 may include a control unit 5100. The control unit 5100 may include all types of devices capable of processing data, such as a processor. Herein, the 'processor' may refer to a data processing device, embedded in hardware, that has a physically structured circuit to perform functions represented by codes or instructions included in, for example, a program. Examples of the data processing device embedded in hardware may include a microprocessor, a central processing unit (CPU), a processor core, an application-specific integrated circuit (ASIC), a field programmable gate array (FPGA), a multiprocessor, and the like, but the present disclosure is not limited thereto. For example, the control unit 5100 may include at least one of a printed circuit board (PCB), a computer, a laptop, and a server. The control unit 5100 may be electrically connected to the wire holder unit 1000, the fiber forming unit 2000, and the solution supply unit 3000.

The wire coating device 10 may include a touch screen 5200. The touch screen 5200 may display a screen. The touch screen 5200 may acquire a touch input. The touch screen 5200 may be referred to as an input unit. Information input to the touch screen 5200 may be related to the operation of at least one of the wire holder unit 1000, the fiber forming unit 2000, and the solution supply unit 3000.

Figure 2:
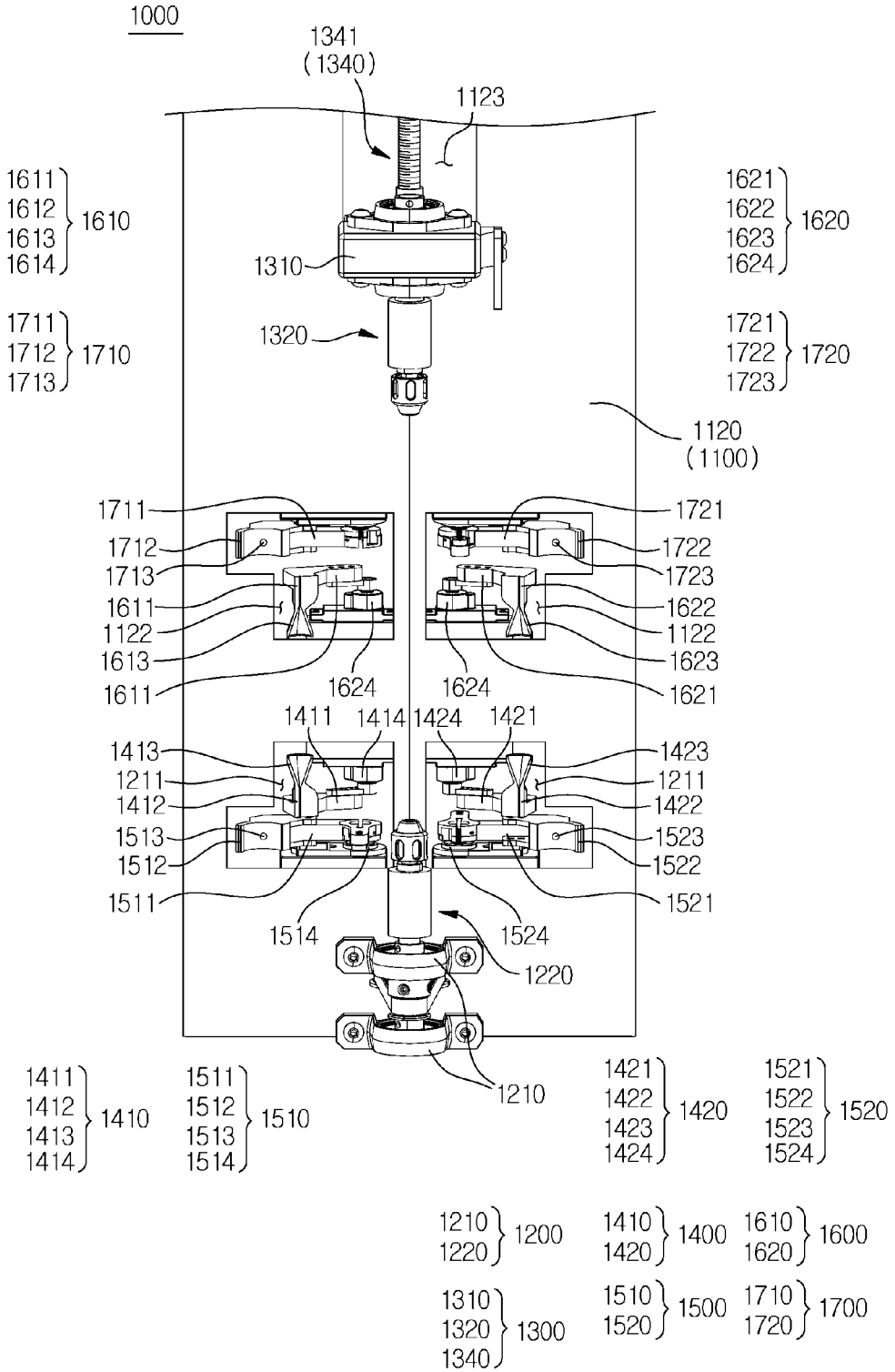
FIG. 2 illustrates a wire holder unit 1000 according to an embodiment of the present disclosure.
Figure 3:
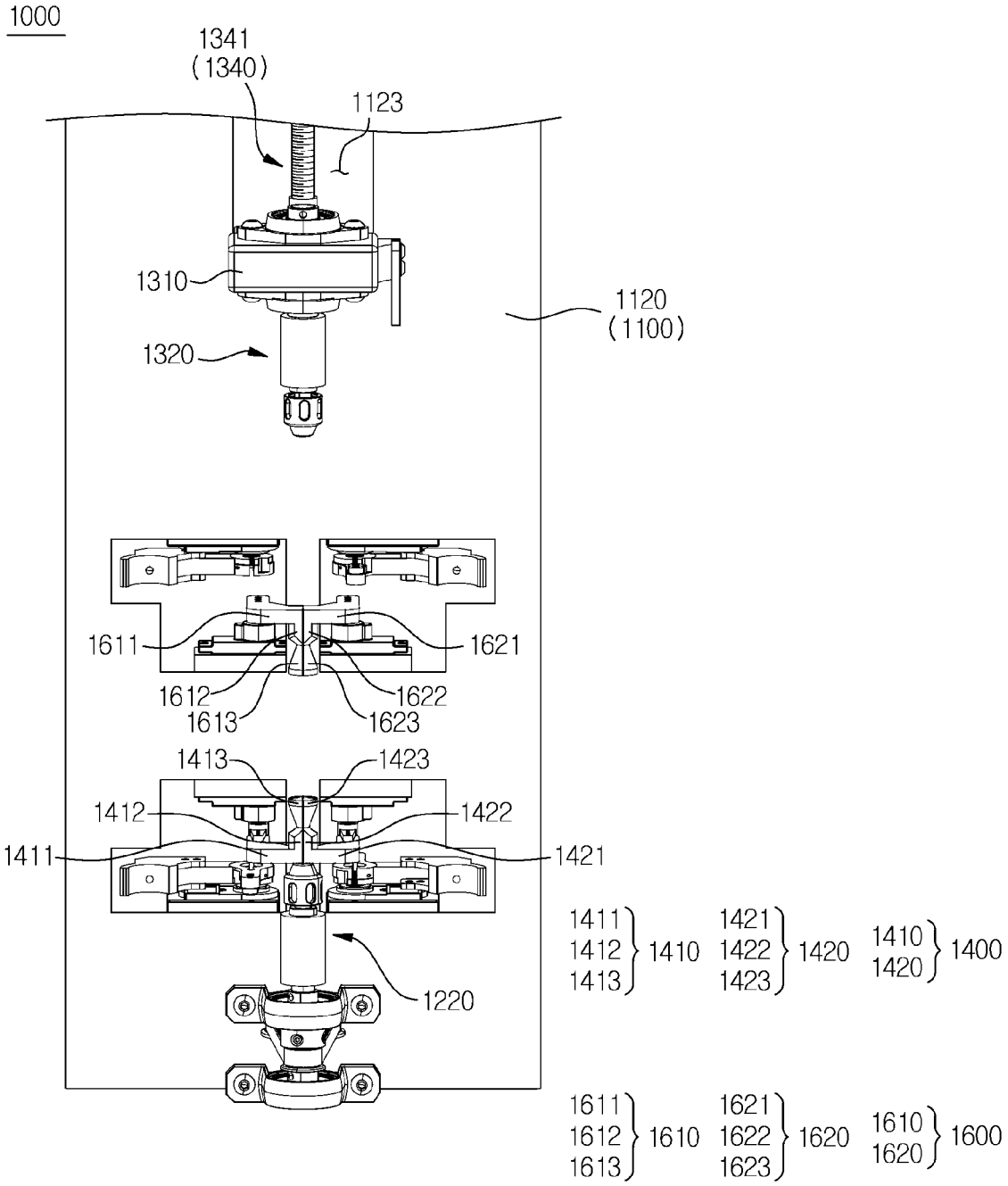
FIG. 3 illustrates a state in which guide modules 1400 and 1600 of FIG. 2 move forward.

FIG. 2 illustrates the wire holder unit 1000 according to an embodiment of the present disclosure. More specifically, FIG. 2 illustrates the wire holder unit 1000 when viewed from the front. FIG. 3 illustrates a state in which guide modules 1400 and 1600 of FIG. 2 move forward.

Referring to FIGS. 2 and 3, the wire holder unit 1000 may include a holder body 1100. The holder body 1100 may be installed in the casing unit 4000 (see FIG. 1). A holder front surface 1120 may indicate a front surface of the holder body 1100. A plurality of openings may be formed in the holder front surface 1120. For example, a holder first opening 1121, a holder second opening 1122, and a holder third holder 1123 may be provided in the holder front surface 1120.

The first opening 1121 may be positioned under the second opening 1122 and the third opening 1123. The third opening 1123 may be positioned on the second opening 1122. The second opening 1122 may be positioned between the first opening 1121 and the third opening 1123. The third opening 1123 may have a shape elongated in the third direction DR3.

The wire holder unit 1000 may include a first wire holder module 1200. The first wire holder module 1200 may be coupled to or installed in the holder body 1100.

The first wire holder module 1200 may include a first wire holder frame 1210. The first wire holder frame 1210 may be coupled or fixed to the holder body 1100. The first wire holder frame 1210 may be coupled or fixed to the holder front surface 1120.

The first wire holder frame 1210 may be positioned below the first opening 1121. The first wire holder module 1200 may include a first chuck 1220. The first chuck 1220 may spin by being coupled to the first wire holder frame 1210.

The first chuck 1220 may be positioned in front of the holder front surface 1120. The first chuck 1220 may be coupled to one end of the wire core.

The wire holder unit 1000 may include a second wire holder module 1300. The second wire holder module 1300 may be coupled to or installed in the holder body 1100. The wire holder modules 1200 and 1300 may indicate at least one of the first wire holder module 1200 and the second wire holder module 1300.

The second wire holder module 1300 may include a second wire holder frame 1310. The second wire holder frame 1310 may be positioned in the third opening 1123. The second wire holder frame 1310 may move up and down in the third opening 1123. When the second wire holder frame 1310 moves in the third opening 1123, a distance between the second wire holder frame 1310 and the first wire holder module 1200 may change. That is, the distance between the second wire holder frame 1310 and the first wire holder module 1200 may depend on the movement of the second wire holder frame 1310.

The second wire holder module 1300 may include a second chuck 1320. The second chuck 1320 may spin by being coupled to the second wire holder frame 1310. The second chuck 1320 may be positioned in front of the holder front surface 1120. The second chuck 1320 may be positioned on the first chuck 1220. The second chuck 1320 may face the first chuck 1220. The second chuck 1320 may be coupled to other end of the wire core. The chucks 1220 and 1320 may indicate at least one of the first chuck 1220 and the second chuck 1320.

When the second wire holder frame 1310 moves in the third holder 1123, a distance between the first chuck 1220 and the second chuck 1320 may change. For example, when the second wire holder frame 1310 moves up in the third holder 1123, the distance between the first chuck 1220 and the second chuck 1320 may increase. For example, when the second wire holder frame 1310 moves down in the third holder 1123, the distance between the first chuck 1220 and the second chuck 1320 may decrease.

The second wire holder module 1300 may include a wire holder lifting part 1340. The wire holder lifting part 1340 may be installed in the holder body 1100. The wire holder lifting part 1340 may be coupled to the second wire holder frame 1310.

The wire holder lifting part 1340 may lift the second wire holder frame 1310. The second wire holder frame 1310 may move along a longitudinal direction of the third opening 1123. The longitudinal direction of the third opening 1123 may be, for example, a direction in which the third opening 1123 is elongated, or the third direction DR3 (see FIG. 1). For example, the longitudinal direction of the third opening 1123 may be parallel to a direction from the first chuck 1220 toward the second chuck 1320. For example, the first chuck 1220, the second chuck 1320, and the third opening 1123 may be positioned on the same line.

The wire holder lifting part 1340 may include a wire holder lifting rod 1341. A longitudinal direction of the wire holder lifting rod 1341 may be parallel to the longitudinal direction of the third opening 1123. The wire holder lifting rod 1341 may be installed in or coupled to the holder body 1100.

The second wire holder frame 1310 may be coupled to the wire holder lifting rod 1341. The second wire holder frame 1310 may move along the wire holder lifting rod 1341. For example, the second wire holder frame 1310 and the wire holder lifting rod 1341 may be screwed. For example, a thread may be formed on an outer surface of the wire holder lifting rod 1341, and a thread may be formed on an inner circumferential surface of the second wire holder frame 1310.

In a state in which one end of the wire core is coupled to the first chuck 1220 and other end of the wire core is coupled to the second chuck 1320, the second wire holder frame 1310 may move up. When the second wire holder frame 1310 moves up, the second chuck 1320 may be moved away from the first chuck 1220. When the second chuck 1320 is away from the first chuck 1220, a tension may be formed in the wire core.

The wire holder unit 1000 may include a first guide module 1400. The first guide module 1400 may be installed in or coupled to the holder body 1100. The first guide module 1400 may be adjacent to the first opening 1121. For example, at least a part of the first guide module 1400 may be exposed to the outside through the first opening 1121.

The first guide module 1400 may include a first guide first wing 1410 and a first guide second wing 1420. The first guide wings 1410 and 1420 may indicate at least one of the first guide first wing 1410 and the first guide second wing 1420.

The first guide wings 1410 and 1420 may include first guide arms 1411 and 1421. The first guide first wing 1410 may include a first guide first arm 1411. The first guide second wing 1420 may include a first guide second arm 1421. The first guide arms 1411 and 1421 may indicate at least one of the first guide first arm 1411 and the first guide second arm 1421.

The first guide arms 1411 and 1421 may move inside and outside the holder body 1100 through the first opening 1121. For example, the first guide arms 1411 and 1421 may be positioned inside the holder body 1100 as illustrated in FIG. 2. For another example, at least some of the first guide arms 1411 and 1421 may be positioned outside the holder body 1100 as illustrated in FIG. 3.

The first guide wings 1410 and 1420 may include first guide drivers 1414 and 1424. The first guide first wing 1410 may include a first guide first driver 1414. The first guide second wing 1420 may include a first guide second driver 1424. The first guide drivers 1414 and 1424 may indicate at least one of the first guide first driver 1414 and the first guide second driver 1424.

The first guide drivers 1414 and 1424 may be installed inside the holder body 1100. The first guide drivers 1414 and 1424 may be coupled to the first guide arms 1411 and 1421. For example, the first guide first driver 1414 may be coupled to the first guide first arm 1411. For example, the first guide second driver 1424 may be coupled to the first guide second arm 1421.

The first guide drivers 1414 and 1424 may move the first guide first arm 1411 and the first guide second arm 1421. For example, the first guide drivers 1414 and 1424 may allow the first guide first arm 1411 and the first guide second arm 1421 to be positioned in front of the holder front surface 1120 by rotating the first guide first arm 1411 and the first guide second arm 1421. When the first guide first arm 1411 and the first guide second arm 1421 are positioned in front of the holder front surface 1120, the first guide first arm 1411 and the first guide second arm 1421 may approach each other.

The first guide wings 1410 and 1420 may include first guide passages 1412 and 1422. For example, the first guide first wing 1410 may include a first guide first passage 1412. For example, the first guide second wing 1420 may include a first guide second passage 1422. The first guide first passage 1412 may be connected to an end of the first guide first arm 1411. The first guide second passage 1422 may be connected to an end of the first guide second arm 1421.

The first guide passages 1412 and 1422 may indicate at least one of the first guide first passage 1412 and the first guide second passage 1422. A longitudinal direction of the first guide passages 1412 and 1422 may be parallel to the third direction DR3 (see FIG. 1). The first guide first passage 1412 and the first guide second passage 1422 may be grooves elongated in the longitudinal direction.

When the first guide first arm 1411 and the first guide second arm 1421 move forward and approach each other in the holder body 1100, the first guide first passage 1412 and the first guide second passage 1422 may approach and face each other. When the first guide first passage 1412 and the first guide second passage 1422 approach and face each other, the first guide passages 1412 and 1422 may form a passage. When the first guide first passage 1412 and the first guide second passage 1422 approach and face each other, the first guide passages 1412 and 1422 may lead to the first chuck 1220. The wire core may be guided to the first chuck 1220 along the first guide passages 1412 and 1422.

The first guide wings 1410 and 1420 may include first guide cones 1413 and 1423. For example, the first guide first wing 1410 may include a first guide first cone 1413. The first guide first cone 1413 may be connected to the first guide first passage 1412. The first guide first cone 1413 may extend upward from the first guide first passage 1412. For example, the first guide second wing 1420 may include a first guide second cone 1423. The first guide second cone 1423 may be connected to the first guide second passage 1422. The first guide second cone 1423 may extend upward from the first guide second passage 1422. The first guide cones 1413 and 1423 may indicate at least one of the first guide first cone 1413 and the first guide second cone 1423.

When the first guide first arm 1411 and the first guide second arm 1421 move forward and approach each other in the holder body 1100, the first guide first cone 1413 and the first guide second cone 1423 may approach and face each other. When the first guide first cone 1413 and the first guide second cone 1423 approach and face each other, the first guide cones 1413 and 1423 may form a funnel shape. Thus, when the wire core is inserted into the first guide cones 1413 and 1423, the wire core can easily pass through the first guide passages 1412 and 1422 and reach the first chuck 1220.

The wire holder unit 1000 may include a second guide module 1600. The second guide module 1600 may be installed in or coupled to the holder body 1100. The second guide module 1600 may be adjacent to the second opening 1122. For example, at least a part of the second guide module 1600 may be exposed to the outside through the second opening 1122. The second guide module 1600 may be positioned on the first guide module 1400.

The second guide module 1600 may include a second guide first wing 1610 and a second guide second wing 1620. The second guide wings 1610 and 1620 may indicate at least one of the second guide first wing 1610 and the second guide second wing 1620.

The second guide wings 1610 and 1620 may include second guide arms 1611 and 1621. The second guide first wing 1610 may include a second guide first arm 1611. The second guide second wing 1620 may include a second guide second arm 1621. The second guide arms 1611 and 1621 may indicate at least one of the second guide first arm 1611 and the second guide second arm 1621.

The second guide arms 1611 and 1621 may move inside and outside the holder body 1100 through the second opening 1122. For example, the second guide arms 1611 and 1621 may be positioned inside the holder body 1100 as illustrated in FIG. 2. For another example, the second guide arms 1611 and 1621 may be positioned outside the holder body 1100 as illustrated in FIG. 3.

The second guide wings 1610 and 1620 may include second guide drivers 1614 and 1624. The second guide first wing 1610 may include a second guide first driver 1614. The second guide second wing 1620 may include a second guide second driver 1624. The second guide drivers 1614 and 1624 may indicate at least one of the second guide first driver 1614 and the second guide second driver 1624.

The second guide drivers 1614 and 1624 may be installed inside the holder body 1100. The second guide drivers 1614 and 1624 may be coupled to the second guide arms 1611 and 1621. For example, the second guide first driver 1614 may be coupled to the second guide first arm 1611. For example, the second guide second driver 1624 may be coupled to the second guide second arm 1621.

The second guide drivers 1614 and 1624 may move the second guide first arm 1611 and the second guide second arm 1621. For example, the second guide drivers 1614 and 1624 may allow the second guide first arm 1611 and the second guide second arm 1621 to be positioned in front of the holder front surface 1120 by rotating the second guide first arm 1611 and the second guide second arm 1621. When the second guide first arm 1611 and the second guide second arm 1621 are positioned in front of the holder front surface 1120, the second guide first arm 1611 and the second guide second arm 1621 may approach each other.

The second guide wings 1610 and 1620 may include second guide passages 1612 and 1622. For example, the second guide first wing 1610 may include a second guide first passage 1612. For example, the second guide second wing 1620 may include a second guide second passage 1622. The second guide first passage 1612 may be connected to an end of the second guide first arm 1611. The second guide second passage 1622 may be connected to an end of the second guide second arm 1621.

The second guide passages 1612 and 1622 may indicate at least one of the second guide first passage 1612 and the second guide second passage 1622. A longitudinal direction of the second guide passages 1612 and 1622 may be parallel to the third direction DR3 (see FIG. 1). The second guide first passage 1612 and the second guide second passage 1622 may be grooves elongated in the longitudinal direction.

When the second guide first arm 1611 and the second guide second arm 1621 move forward and approach each other in the holder body 1100, the second guide first passage 1612 and the second guide second passage 1622 may approach and face each other. When the second guide first passage 1612 and the second guide second passage 1622 approach and face each other, the second guide passages 1612 and 1622 may form a passage. When the second guide first passage 1612 and the second guide second passage 1622 approach and face each other, the second guide passages 1612 and 1622 may lead to the second chuck 1320. The wire core may be guided to the second chuck 1320 along the second guide passages 1612 and 1622.

The second guide wings 1610 and 1620 may include second guide cones 1613 and 1623. For example, the second guide first wing 1610 may include a second guide first cone 1613. The second guide first cone 1613 may be connected to the second guide first passage 1612. The second guide first cone 1613 may extend downward from the second guide first passage 1612. For example, the second guide second wing 1620 may include a second guide second cone 1623.

The second guide second cone 1623 may be connected to the second guide second passage 1622. The second guide second cone 1623 may extend downward from the second guide second passage 1622. The second guide cones 1613 and 1623 may indicate at least one of the second guide first cone 1613 and the second guide second cone 1623.

When the second guide first arm 1611 and the second guide second arm 1621 move forward and approach each other in the holder body 1100, the second guide first cone 1613 and the second guide second cone 1623 may approach and face each other. When the second guide first cone 1613 and the second guide second cone 1623 approach and face each other, the second guide cones 1613 and 1623 may form a funnel shape. Thus, when the wire core is inserted into the second guide cones 1613 and 1623, the wire core can easily pass through the second guide passages 1612 and 1622 and reach the second chuck 1320.

The wire holder unit 1000 may include a first coupling module 1500. The first coupling module 1500 may be installed in or coupled to the holder body 1100. The first coupling module 1500 may be adjacent to the first opening 1121. For example, at least a part of the first coupling module 1500 may be exposed to the outside through the first opening 1121. The first coupling module 1500 may be adjacent to the first guide module 1400.

The wire holder unit 1000 may include a second coupling module 1700. The second coupling module 1700 may be installed in or coupled to the holder body 1100. The second coupling module 1700 may be adjacent to the second opening 1122. For example, at least a part of the second coupling module 1700 may be exposed to the outside through the second opening 1122. The second coupling module 1700 may be adjacent to the second guide module 1600.

The wire holder unit 1000 may include the first coupling module 1500. The first coupling module 1500 may include a first coupling first wing 1510 and a first coupling second wing 1520. The first coupling wings 1510 and 1520 may indicate at least one of the first coupling first wing 1510 and the first coupling second wing 1520.

The first coupling wings 1510 and 1520 may include first coupling arms 1511 and 1521. The first coupling first wing 1510 may include a first coupling first arm 1511. The first coupling second wing 1520 may include a first coupling second arm 1521. The first coupling arms 1511 and 1521 may indicate at least one of the first coupling first arm 1511 and the first coupling second arm 1521.

Figure 6:
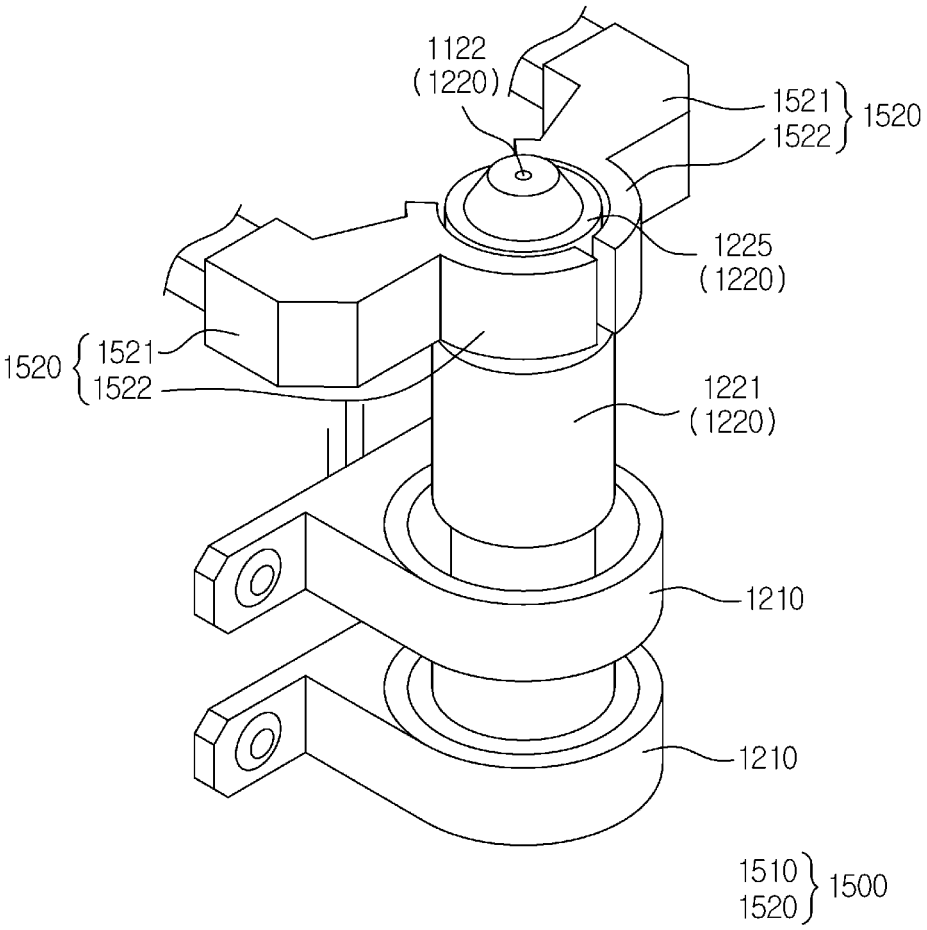
FIG. 6 illustrates that a first coupling module is coupled to a chuck groove.

The first coupling arms 1511 and 1521 may move inside and outside the holder body 1100 through the first opening 1121. For example, the first coupling arms 1511 and 1521 may be positioned inside the holder body 1100 as illustrated in FIG. 2. For another example, at least some of the first coupling arms 1511 and 1521 may be positioned outside the holder body 1100 as illustrated in FIG. 6.

The first coupling wings 1510 and 1520 may include first coupling drivers 1514 and 1524. The first coupling first wing 1510 may include a first coupling first driver 1514. The first coupling second wing 1520 may include a first coupling second driver 1524. The first coupling drivers 1514 and 1524 may indicate at least one of the first coupling first driver 1514 and the first coupling second driver 1524.

The first coupling drivers 1514 and 1524 may be installed inside the holder body 1100. The first coupling drivers 1514 and 1524 may be coupled to the first coupling arms 1511 and 1521. For example, the first coupling first driver 1514 may be coupled to the first coupling first arm 1511. For example, the first coupling second driver 1524 may be coupled to the first coupling second arm 1521.

The first coupling drivers 1514 and 1524 may move the first coupling first arm 1511 and the first coupling second arm 1521. For example, the first coupling drivers 1514 and 1524 may allow the first coupling first arm 1511 and the first coupling second arm 1521 to be positioned in front of the holder front surface 1120 by rotating the first coupling first arm 1511 and the first coupling second arm 1521. When the first coupling first arm 1511 and the first coupling second arm 1521 are positioned in front of the holder front surface 1120, the first coupling first arm 1511 and the first coupling second arm 1521 may approach each other.

The first coupling wings 1510 and 1520 may include first coupling holders 1512 and 1522. For example, the first coupling first wing 1510 may include a first coupling first holder 1512. The first coupling first holder 1512 may be coupled to or positioned at an end of the first coupling first arm 1511. For example, the first coupling second wing 1520 may include a first coupling second holder 1522. The first coupling second holder 1522 may be coupled to or positioned at an end of the first coupling second arm 1521. The first coupling holders 1512 and 1522 may indicate at least one of the first coupling first holder 1512 and the first coupling second holder 1522.

When the first coupling first arm 1511 and the first coupling second arm 1521 move forward and approach each other in the holder body 1100, the first coupling first holder 1512 and the first coupling second holder 1522 may approach and face each other.

The first coupling wings 1510 and 1520 may include first coupling protrusions 1513 and 1523. For example, the first coupling first wing 1510 may include a first coupling first protrusion 1513. The first coupling first protrusion 1513 may protrude from the first coupling first holder 1512. For example, the first coupling second wing 1520 may include a first coupling second protrusion 1523. The first coupling second protrusion 1523 may protrude from the first coupling second holder 1522. For another example, the first coupling protrusions 1513 and 1523 may protrude from the first coupling wings 1510 and 1520.

When the first coupling first holder 1512 and the first coupling second holder 1522 approach and face each other, the first coupling first protrusion 1513 and the first coupling second protrusion 1523 may approach and face each other.

The wire holder unit 1000 may include the second coupling module 1700. The second coupling module 1700 may include a second coupling first wing 1710 and a second coupling second wing 1720. The second coupling wings 1710 and 1720 may indicate at least one of the second coupling first wing 1710 and the second coupling second wing 1720.

The second coupling wings 1710 and 1720 may include second coupling arms 1711 and 1721. The second coupling first wing 1710 may include a second coupling first arm 1711. The second coupling second wing 1720 may include a second coupling second arm 1721. The second coupling arms 1711 and 1721 may indicate at least one of the second coupling first arm 1711 and the second coupling second arm 1721.

The second coupling arms 1711 and 1721 may move inside and outside the holder body 1100 through the second opening 1122. For example, the second coupling arms 1711 and 1721 may be positioned inside the holder body 1100 as illustrated in FIG. 2. For another example, at least some of the second coupling arms 1711 and 1721 may be positioned outside the holder body 1100.

The second coupling wings 1710 and 1720 may include second coupling drivers 1714 and 1724. The second coupling first wing 1710 may include a second coupling first driver 1714. The second coupling second wing 1720 may include a second coupling second driver 1724. The second coupling drivers 1714 and 1724 may indicate at least one of the second coupling first driver 1714 and the second coupling second driver 1724.

The second coupling drivers 1714 and 1724 may be installed inside the holder body 1100. The second coupling drivers 1714 and 1724 may be coupled to the second coupling arms 1711 and 1721. For example, the second coupling first driver 1714 may be coupled to the second coupling first arm 1711. For example, the second coupling second driver 1724 may be coupled to the second coupling second arm 1721.

The second coupling drivers 1714 and 1724 may move the second coupling first arm 1711 and the second coupling second arm 1721. For example, the second coupling drivers 1714 and 1724 may allow the second coupling first arm 1711 and the second coupling second arm 1721 to be positioned in front of the holder front surface 1120 by rotating the second coupling first arm 1711 and the second coupling second arm 1721. When the second coupling first arm 1711 and the second coupling second arm 1721 are positioned in front of the holder front surface 1120, the second coupling first arm 1711 and the second coupling second arm 1721 may approach each other.

The second coupling wings 1710 and 1720 may include second coupling holders 1712 and 1722. For example, the second coupling first wing 1710 may include a second coupling first holder 1712. The second coupling first holder 1712 may be coupled to or positioned at an end of the second coupling first arm 1711. For example, the second coupling second wing 1720 may include a second coupling second holder 1722. The second coupling second holder 1722 may be coupled to or positioned at an end of the second coupling second arm 1721. The second coupling holders 1712 and 1722 may indicate at least one of the second coupling first holder 1712 and the second coupling second holder 1722.

When the second coupling first arm 1711 and the second coupling second arm 1721 move forward and approach each other in the holder body 1100, the second coupling first holder 1712 and the second coupling second holder 1722 may approach and face each other.

The second coupling wings 1710 and 1720 may include second coupling protrusions 1713 and 1723. For example, the second coupling first wing 1710 may include a second coupling first protrusion 1713. The second coupling first protrusion 1713 may protrude from the second coupling first holder 1712. For example, the second coupling second wing 1720 may include a second coupling second protrusion 1723. The second coupling second protrusion 1723 may protrude from the second coupling second holder 1722. For another example, the second coupling protrusions 1713 and 1723 may protrude from the second coupling wings 1710 and 1720.

When the second coupling first holder 1712 and the second coupling second holder 1722 approach and face each other, the second coupling first protrusion 1713 and the second coupling second protrusion 1723 may approach and face each other.

A line formed by the wire core connected from the first wire holder module 1200 to the second wire holder module 1300 may be considered. The line formed by the wire core may be referred to as a "central line". The central line may be positioned between the first guide first wing 1410 and the first guide second wing 1420. The central line may be positioned between the second guide first wing 1610 and the second guide second wing 1620. The central line may be positioned between the first coupling first wing 1510 and the first coupling second wing 1520. The central line may be positioned between the second coupling first wing 1710 and the second coupling second wing 1720.

Figure 4:
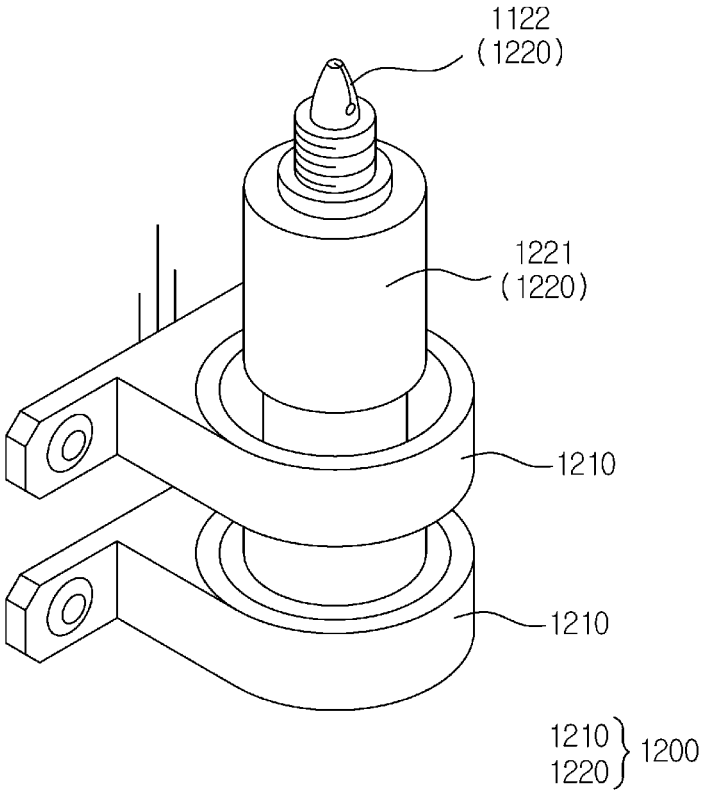
FIG. 4 illustrates a first chuck 1220 according to an embodiment of the present disclosure.

FIG. 4 illustrates the first chuck 1220 according to an embodiment of the present disclosure. A structure of the second chuck 1320 (see FIG. 3) may be substantially the same as a structure of the first chuck 1220. The chucks 1220 and 1320 may indicate at least one of the first chuck 1220 and the second chuck 1320.

Referring to FIG. 4, the chuck 1220 may include a chuck body 1221. The chuck body 1221 may be coupled to the first wire holder frame 1210. The chuck body 1221 may have a shape elongated in the third direction DR3 (see FIG. 1). A longitudinal direction of the chuck body 1221 may be parallel to the third direction DR3 (see FIG. 1). An axial direction of the chuck body 1221 may be the longitudinal direction of the chuck body 1221. The chuck body 1221 may spin in the first wire holder frame 1210. For example, The chuck body 1221 may spin around the axial direction of the chuck body 1221.

The chuck 1220 may include a chuck jaw 1222. The plurality of chuck jaws 1222 may be provided. The plurality of chuck jaws 1222 may be formed at an end of the chuck body 1221. The plurality of chuck jaws 1222 may form a space at a spin axis of the chuck body 1221 in the axial direction.

The plurality of chuck jaws 1222 may be away from or close to the spin axis of the chuck body 1221. The fact that the plurality of chuck jaws 1222 are opened may mean the plurality of chuck jaws 1222 is away from the spin axis of the chuck body 1221. The fact that the plurality of chuck jaws 1222 retract may mean the plurality of chuck jaws 1222 is close to the spin axis of the chuck body 1221.

Figure 5:
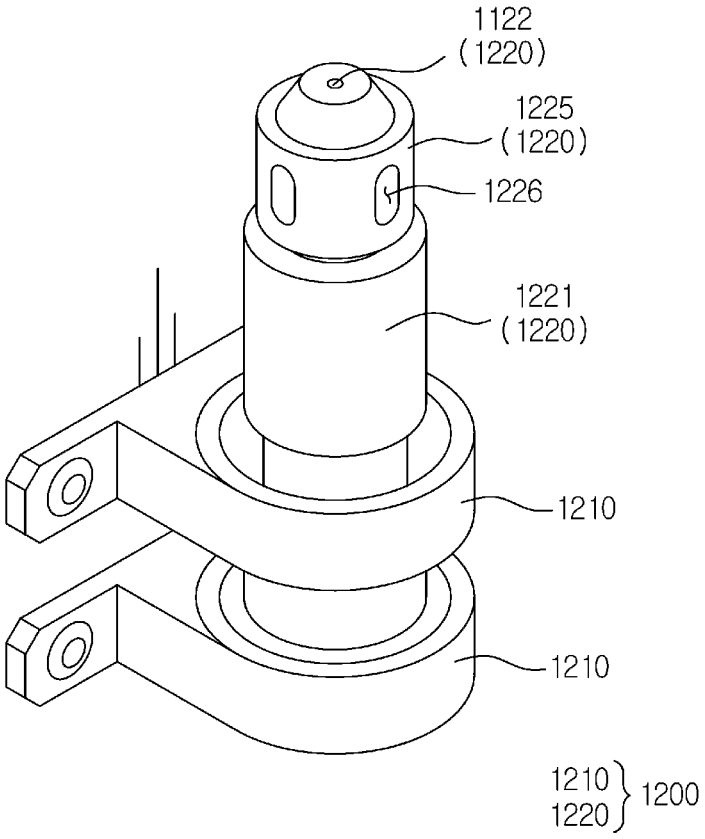
FIG. 5 illustrates that a chuck sleeve 1225 is coupled to a chuck jaw of FIG. 4.

FIG. 5 illustrates that a chuck sleeve 1225 is coupled to a chuck jaw of FIG. 4.

Referring to FIG. 5, the chuck sleeve 1225 may be coupled to the chuck jaw 1222. The chuck sleeve 1225 may surround the plurality of chuck jaws 1222 in a spin direction of the chuck body 1221.

A chuck groove 1226 may be formed in the chuck sleeve 1225. The chuck groove 1226 may be formed to be recessed from the chuck sleeve 1225. The chuck groove 1226 may have a shape elongated in a longitudinal direction of the chuck groove 1226. The longitudinal direction of the chuck groove 1226 may be parallel to the spin direction of the chuck body 1221. The chuck groove 1226 may be an opening formed in the chuck groove 1226.

FIG. 6 illustrates that a first coupling module is coupled to a chuck groove. Referring to FIG. 6, the first coupling first wing 1510 and the first coupling second wing 1520 may move in front of the holder front surface 1100 (see FIG. 2). The first coupling first holder 1512 and the first coupling second holder 1522 may face each other. The chuck sleeve 1225 may be positioned between the first coupling first holder 1512 and the first coupling second holder 1522. When the first coupling first holder 1512 and the first coupling second holder 1522 face each other, the first coupling protrusions 1513 and 1523 (see FIG. 2) may be inserted into the chuck grooves 1226 (see FIG. 5).

The configuration of FIG. 6 may be described with reference to FIGS. 2 and 5. Referring to FIGS. 2, 5 and 6, the end of the wire core may be fitted and coupled to the plurality of chuck jaws 1222. In a state in which the plurality of chuck jaws 1222 are opened, the end of the wire core may be inserted between the plurality of chuck jaws 1222. When the plurality of chuck jaws 1222 retract in the state in which the end of the wire core is inserted between the plurality of chuck jaws 1222, the end of the wire core may be coupled to the plurality of chuck jaws 1222.

In a state in which the end of the wire core is inserted between the plurality of chuck jaws 1222, the first coupling protrusions 1513 and 1523 may be positioned in the chuck grooves 1226. When the first coupling protrusions 1513 and 1523 are positioned in the chuck grooves 1226, the chuck sleeve 1225 may be fixed with respect to the spin direction of the chuck body 1221. When the chuck body 1221 spins in the state in which the first coupling protrusions 1513 and 1523 are positioned in the chuck grooves 1226, the plurality of chuck jaws 1222 may spin with respect to the chuck sleeve 1225. In other words, the chuck sleeve 1225 may spin with respect to the plurality of chuck jaws 1222. When the chuck sleeve 1225 spins in a first spin direction with respect to the plurality of chuck jaws 1222, the chuck sleeve 1225 may retract the plurality of chuck jaws 1222. When the plurality of chuck jaws 1222 retract, the end of the wire core may be coupled to the first chuck 1220. As another example, when the chuck sleeve 1225 spins in a second spin direction with respect to the plurality of chuck jaws 1222, the plurality of chuck jaws 1222 may be opened. The second spin direction may be a direction opposite to the first spin direction. When the plurality of chuck jaws 1222 are opened, the wire core may be separated from the first chuck 1220.

Figure 7:
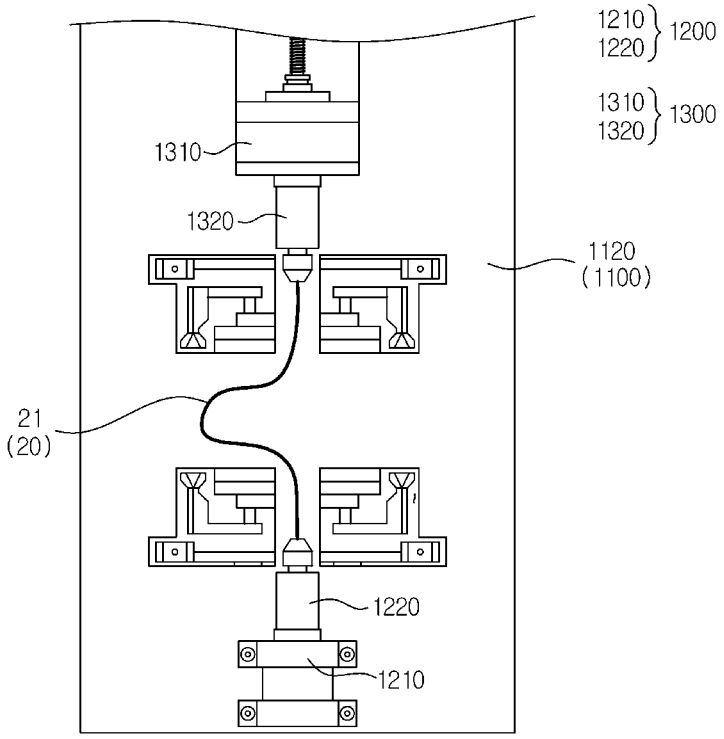
FIG. 7 illustrates that a wire core is coupled to a wire holder unit.

FIG. 7 illustrates that a wire core is coupled to a wire holder unit.

Referring to FIG. 7, a wire core 21 may be coupled or fixed to the wire holder unit 1000. For example, one end of the wire core 21 may be coupled or fixed to the first wire holder module 1200. For example, other end of the wire core 21 may be coupled or fixed to the second wire holder module 1300.

A distance between the first chuck 1220 and the second chuck 1320 may be less than a length of the wire core 21. Thus, tension may not be formed in the wire core 21. In other words, the wire core 21 may not be in a taut state. In this case, it may be difficult to cover or coat the fiber on the wire core 21.

The second chuck 1320 may spin in the axial direction while being coupled to the second wire holder frame 1310. The second chuck 1320 may be constrained by a translational movement of the second wire holder frame 1310. The second wire holder frame 1310 may be moved by the wire holder lifting part 1340. Thus, the second chuck 1320 may move in the up-down direction or the third direction DR3 (see FIG. 1) by the wire holder lifting part 1340.

The second wire holder frame 1310 may move from the third opening 1123. For example, the second wire holder frame 1310 may move upward from the third opening 1123. That is, the second wire holder frame 1310 may move in a direction away from the first chuck 1220. When the second wire holder frame 1310 moves in the direction away from the first chuck 1220, the wire core 21 may be pulled taut. That is, tension may be formed in the wire core 21.

Figure 8:
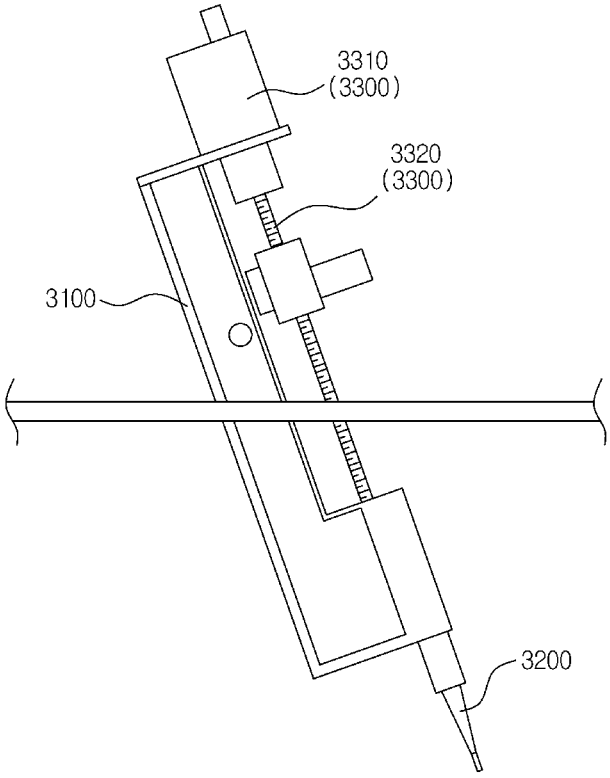
FIG. 8 illustrates a solution supply unit 3000 according to an embodiment of the present disclosure.

FIG. 8 illustrates a solution supply unit 3000 according to an embodiment of the present disclosure.

Referring to FIG. 8, the solution supply unit 3000 may include a solution supply body 3100. The solution supply body 3100 may be installed in the casing unit 4000 (see FIG. 1). The solution supply body 3100 may be installed in, for example, the ceiling 4300 (see FIG. 1).

The solution supply unit 3000 may include a solution supply syringe 3200. The "syringe" may be referred to as an injector. The solution supply syringe 3200 may contain a solution that is a raw material of fiber.

The solution that is the raw material of fiber may be a polymer solution. Examples of polymer material constituting the polymer solution may include at least one of polypropylene, polyethylene, polystyrene, polyethylene oxide, polyethylene terephthalate, polybutylene terephthalate, polyethylene naphthalate, poly-m-phenylene terephthalate, poly-p-phenylene isofurate, polyvinylidene fluoride, polyvinylidene fluoride-hexafluoropropylene copolymer, polyvinyl chloride, poly vinylidene chloride-acrylate copolymer, poly acrylonitrile, polyacrylonitrile-methacrylate copolymer, polycarbonate, polyarylate, polyester carbonate, nylon, aramid, polycaprolactone, polylactic acid, polyglycolic acid, collagen, polyhydroxybutyric acid, polyvinyl acetate, and polypeptide.

Examples of a solvent for the polymer material may include at least one of methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, carbon tetrachloride, 1,1-dichloroethane, 1,2-dichloroethane, trichloroethane, dichloropropane, dibromoethane, dibromopropane, methyl bromide, bromoethyl, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, pyridine, and water.

In addition to the solvent for the polymer material, an inorganic material may be added to the solvent. Examples of the inorganic material added to the solvent may include at least one of oxide, carbide, nitride, boride, silicide, fluoride, and sulfide. For example, if oxide is added to the polymer solution, heat resistance and workability can be improved. Examples of oxide added to the polymer solution may include at least one of $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$.

The solution supply unit 3000 may include a solution supply driver 3300. The solution supply driver 3300 may include a solution supply motor 3310 and a solution supply rod 3320. The solution supply rod 3320 may be installed in the solution supply body 3100 and may provide force to the solution supply syringe 3200. The solution supply motor 3310 may be installed in the solution supply body 3100. The solution supply motor 3310 may provide a driving force to the solution supply rod 3320. The solution supply rod 3320 may transmit the driving force to the solution supply syringe 3200. When the solution supply syringe 3200 receives pressure by a driving force, the solution supply syringe 3200 may discharge the polymer solution.

Figure 9:
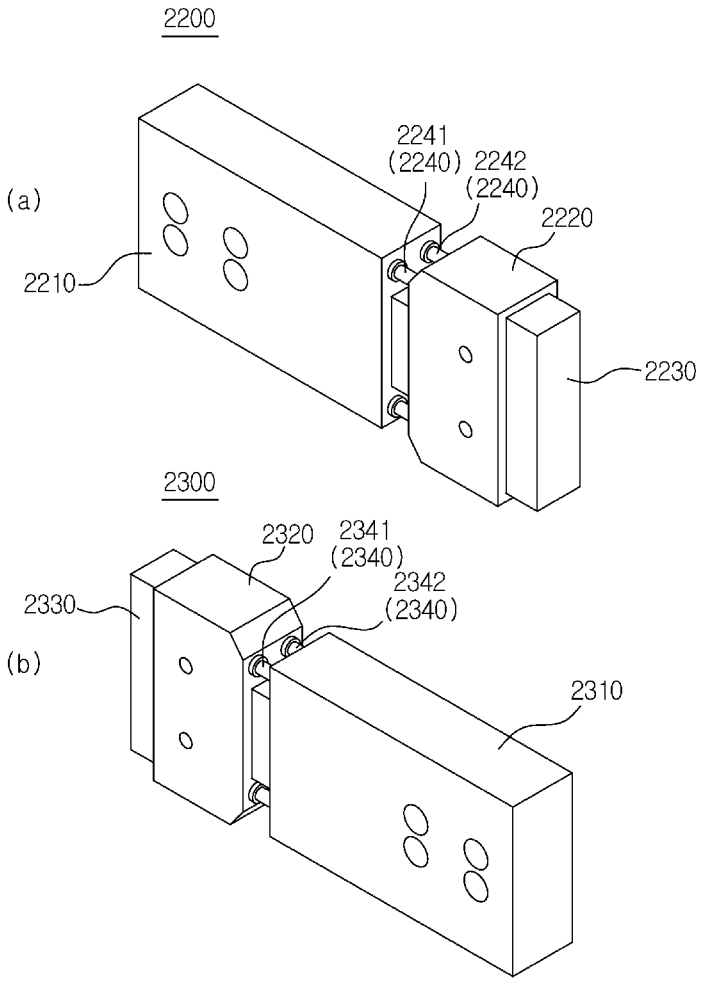
FIG. 9 illustrates a first fiber forming module and a second fiber forming module illustrated in FIG. 1.

FIG. 9 illustrates a first fiber forming module and a second fiber forming module illustrated in FIG. 1.

Referring to FIG. 9, the first fiber forming module 2200 may include a first fiber forming module body 2210, and the second fiber forming module 2300 may include a second fiber forming module body 2310. The fiber forming module bodies 2210 and 2310 may indicate at least one of the first fiber forming module body 2210 and the second fiber forming module body 2310.

The fiber forming module bodies 2210 and 2310 may be coupled to the vertical bar 2125 (see FIG. 1). For example, the first fiber forming module body 2210 may be movably coupled to the first vertical bar 2125*a* (see FIG. 1). For example, the second fiber forming module body 2310 may be movably coupled to the second vertical bar 2125*b* (see FIG. 1).

The first fiber forming module 2200 may include a first fiber forming module head 2220. The second fiber forming module 2300 may include a second fiber forming module head 2320. The fiber forming module heads 2220 and 2320 may indicate at least one of the first fiber forming module head 2220 and the second fiber forming module head 2320.

The fiber forming module heads 2220 and 2320 may be coupled or connected to the fiber forming module bodies 2210 and 2310. For example, the first fiber forming module head 2220 may be coupled or connected to the first fiber forming module body 2210. For example, the second fiber forming module head 2320 may be coupled or connected to the second fiber forming module body 2310.

The first fiber forming module 2200 may include a first fiber forming module connection member 2240. The first fiber forming module connection member 2240 may connect the first fiber forming module body 2210 to the first fiber forming module head 2220. The first fiber forming module connection member 2240 may include, for example, a first fiber forming module first connection member 2241 and a first fiber forming module second connection member 2242.

The second fiber forming module 2300 may include a second fiber forming module connection member 2340. The second fiber forming module connection member 2340 may connect the second fiber forming module body 2310 to the second fiber forming module head 2320. The second fiber forming module connection member 2340 may include, for example, a second fiber forming module first connection member 2341 and a second fiber forming module second connection member 2342.

The fiber forming module connection members 2240 and 2340 may indicate at least one of the first fiber forming module connection member 2240 and the second fiber forming module connection member 2340. The fiber forming module first connection members 2241 and 2341 may indicate at least one of the first fiber forming module first connection member 2241 and the second fiber forming module first connection member 2341. The fiber forming module second connection members 2242 and 2342 may indicate at least one of the first fiber forming module second connection member 2242 and the second fiber forming module second connection member 2342. The fiber forming module first connection members 2241 and 2341 may be positioned in front of the fiber forming module second connection members 2242 and 2342.

The fiber forming module connection members 2240 and 2340 may have elasticity. For example, the fiber forming module connection members 2240 and 2340 may include a spring. A spring constant of the fiber forming module first connection members 2241 and 2341 may be different from a spring constant of the fiber forming module second connection members 2242 and 2342. For example, the spring constant of the fiber forming module first connection members 2241 and 2341 may be greater than the spring constant of the fiber forming module second connection members 2242 and 2342.

The first fiber forming module 2200 may include a first fiber forming module contact member 2230. The second fiber forming module 2300 may include a second fiber forming module contact member 2330. The first fiber forming module contact member 2230 may be coupled to the first fiber forming module head 2220. The second fiber forming module contact member 2330 may be coupled to the second fiber forming module head 2320. The fiber forming module contact members 2230 and 2330 may indicate at least one of the first fiber forming module contact member 2230 and the second fiber forming module contact member 2330.

Figure 10:
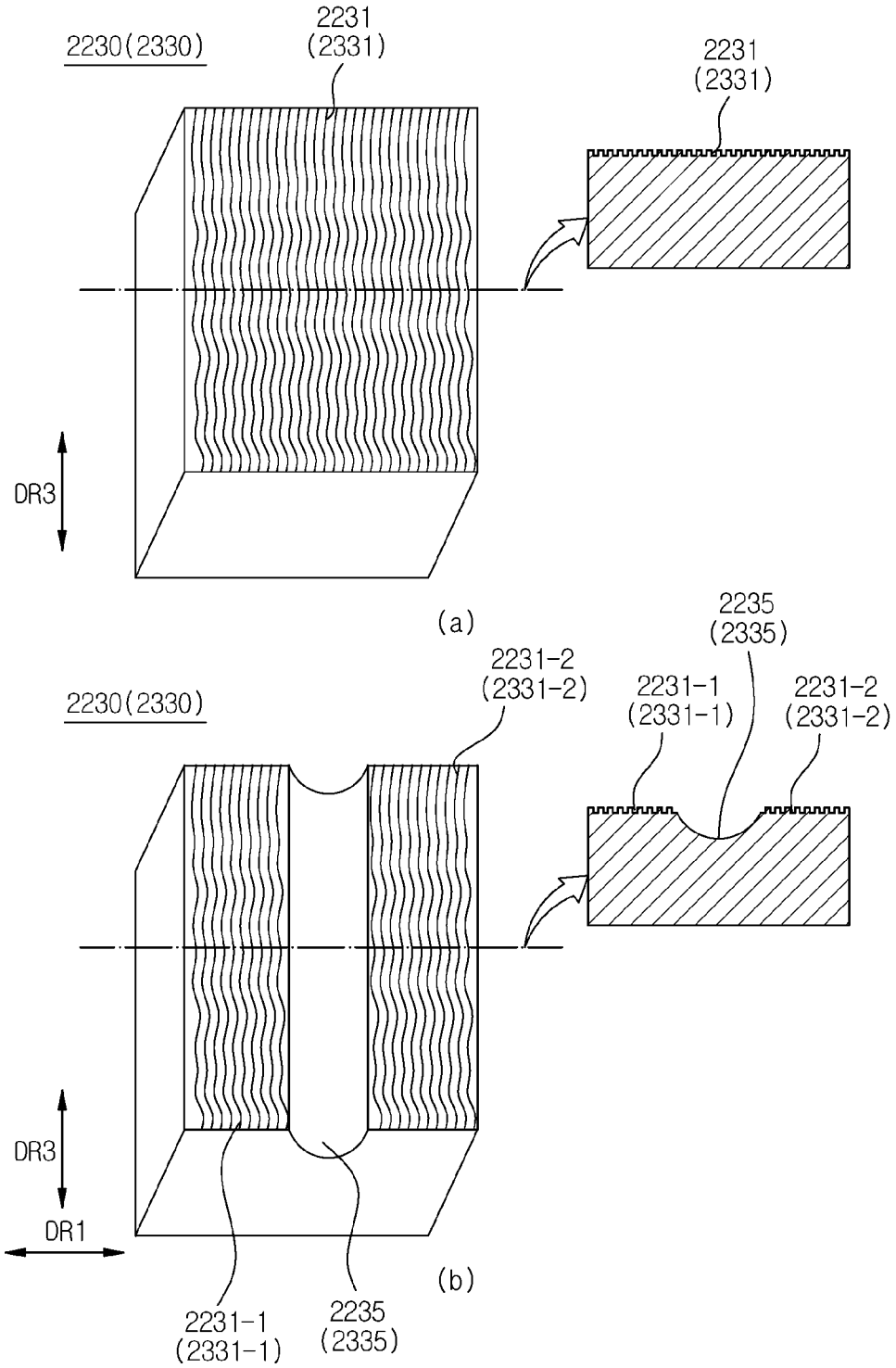
FIG. 10 illustrates a fiber forming module contact member.

FIG. 10 illustrates a fiber forming module contact member.

Referring to (a) of FIG. 10, the fiber forming module contact members 2230 and 2330 may include fiber forming module contact surfaces 2231 and 2331. For example, a first fiber forming module contact surface 2231 may be formed on one surface of the first fiber forming module contact member 2230. For example, a second fiber forming module contact surface 2331 may be formed on one surface of the second fiber forming module contact member 2330. Referring to (a) of FIG. 10 and FIG. 1, the first fiber forming module contact surface 2231 and the second fiber forming module contact surface 2331 may face each other. The fiber forming module contact surfaces 2231 and 2331 may indicate at least one of the first fiber forming module contact surface 2231 and the second fiber forming module contact surface 2331.

Wrinkles may be formed on the fiber forming module contact surfaces 2231 and 2331. The wrinkles formed on the fiber forming module contact surfaces 2231 and 2331 may have a pattern similar to human fingerprints. The polymer solution may be applied to the fiber forming module contact surfaces 2231 and 2331. The wrinkles formed on the fiber forming module contact surfaces 2231 and 2331 may increase a contact area formed in the fiber forming module contact surfaces 2231 and 2331. Thus, an area to which fibers formed of the polymer solution are attached, may increase due to the wrinkles formed on the fiber forming module contact surfaces 2231 and 2331. That is, an amount of fibers formed between the first fiber forming module contact surface 2231 and the second fiber forming module contact surface 2331 may increase by the wrinkles formed on the fiber forming module contact surfaces 2231 and 2331.

Referring to (b) of FIG. 10, a plurality of fiber forming module contact surfaces 2231 and 2331 may be provided. For example, the fiber forming module contact surfaces 2231 and 2331 may include fiber forming module first contact surfaces 2231-1 and 2331-1 and fiber forming module second contact surfaces 2231-2 and 2331-2. Fiber forming module recesses 2235 and 2335 may be formed between the fiber forming module first contact surfaces 2231-1 and 2331-1 and the fiber forming module second contact surfaces 2231-2 and 2331-2. The fiber forming module recesses 2235 and 2335 may be formed to be recessed from the fiber forming module contact surfaces 2231 and 2331. A longitudinal direction of the fiber forming module recesses 2235 and 2335 may be the third direction DR3.

The fiber forming module first contact surfaces 2231-1 and 2331-1 and the fiber forming module second contact surfaces 2231-2 and 2331-2 may be disposed in the first direction DR1 or the front-rear direction. For example, the fiber forming module first contact surfaces 2231-1 and 2331-1, the fiber forming module recesses 2235 and 2335, and the fiber forming module second contact surfaces 2231-2 and 2331-2 may be sequentially disposed in the first direction DR1 or the front-rear direction. The fiber forming module first contact surfaces 2231-1 and 2331-1 may be positioned in front of the fiber forming module second contact surfaces 2231-2 and 2331-2.

The first fiber forming module contact surface 2231 may include the first fiber forming module first contact surface 2231-1 and the first fiber forming module second contact surface 2231-2. The second fiber forming module contact surface 2331 may include the second fiber forming module first contact surface 2331-1 and the second fiber forming module second contact surface 2331-2.

The fiber forming module first contact surfaces 2231-1 and 2331-1 may indicate at least one of the first fiber forming module first contact surface 2231-1 and the second fiber forming module first contact surface 2331-1. The fiber forming module second contact surfaces 2231-2 and 2331-2 may indicate at least one of the first fiber forming module second contact surface 2231-2 and the second fiber forming module second contact surface 2331-2.

Figure 11:
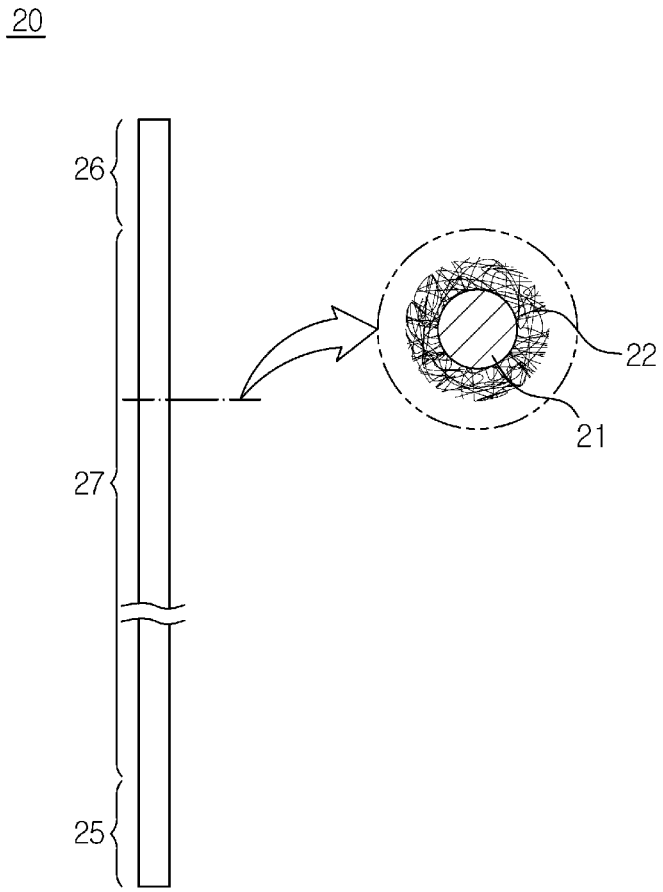
FIG. 11 illustrates a wire 20 according to an embodiment of the present disclosure.

FIG. 11 illustrates a wire 20 according to an embodiment of the present disclosure.

Referring to FIG. 11, the wire 20 may include a wire core 21 and a wire covering portion 22. The wire core 21 may be formed of a material including a flexible material. The rigidity of the wire core 21 may be greater than the rigidity of the wire covering portion 22. For example, the wire core 21 may be formed of a material including plastic. For example, the wire core 21 may be a wire formed of a material including fiber reinforced (FRP). For example, the wire core 21 may be formed of a material including metal. For example, the wire core 21 may be formed of a material including a shape memory alloy. For example, the wire core 21 may be formed of a material including an alloy of nickel and titanium.

The wire core 21 may be used for orthodontic treatment. The wire core 21 is well attached to the teeth at 10 to 15° C., and the wire core 21 may have the properties of recovering to an original arch shape when the temperature increases due to body temperature after being attached. A diameter or thickness of the wire core 21 may vary. That is, the wire cores 21 of various diameters may be used for orthodontic treatment. The wire core 21 may be referred to as an "orthodontic wire".

The wire covering portion 22 may be formed of a material containing a polymer material. For example, referring to FIGS. 1 to 11, when a polymer solution is stretched between the first fiber forming module contact surface 2231 and the second fiber forming module contact surface 2331 to form polymer fibers, the polymer fibers may be covered or coated on the wire core 21 while the formed polymer fibers and the wire core 21 cross each other. The wire covering portion 22 may indicate the polymer fibers covered or coated on the wire core 21.

The wire covering portion may be water-soluble. Therefore, when a bracket is in close contact with an outer surface of the wire 20 and fixes the wire 20, the wire covering portion 22 may be removed when the wire covering portion 22 is exposed to water. When the wire covering portion 22 is removed, the wire core 21 may be exposed to the outside, and a clearance may occur between the bracket and the wire 20.

In the orthodontic treatment, the bracket may be fixed to the teeth and coupled to the wire 20. Since the orthodontic treatment is for the purpose of the movement (fine movement) of teeth, a clearance may be required between the bracket and the wire 20. When "the coated wire 20" according to an embodiment of the present disclosure is used for the orthodontic treatment, the bracket may be formed of a resin. When the bracket is formed of the resin, the size of the bracket may relatively decrease and the aesthetic feeling may be improved. After the resin is bonded to the teeth while covering the wire 20, when the wire covering portion 22 is removed, a clearance may be formed between the resin and the wire 20.

The wire 20 may be classified according to its location. The wire 20 may form an elongated shape from a first end 25 to a second end 26 of the wire 20. A wire coating area 27 may be positioned between the first end 25 and the second end 26 of the wire 20. The wire coating area 27 may be a portion in which the wire covering portion 22 is formed. The first end 25 of the wire 20 may be referred to as an end, and the second end 26 of the wire 20 may be referred to as another end.

Figure 12:
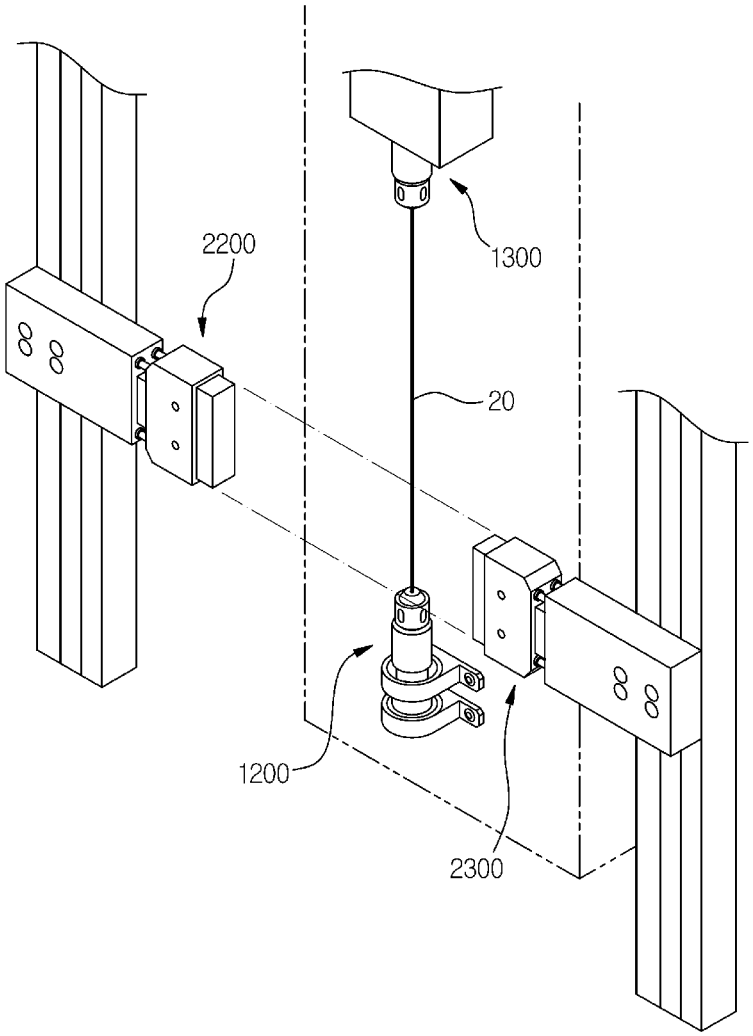
FIGS. 12 to 14 illustrate an operation of a wire coating device 10 according to an embodiment of the present disclosure.
Figure 13:
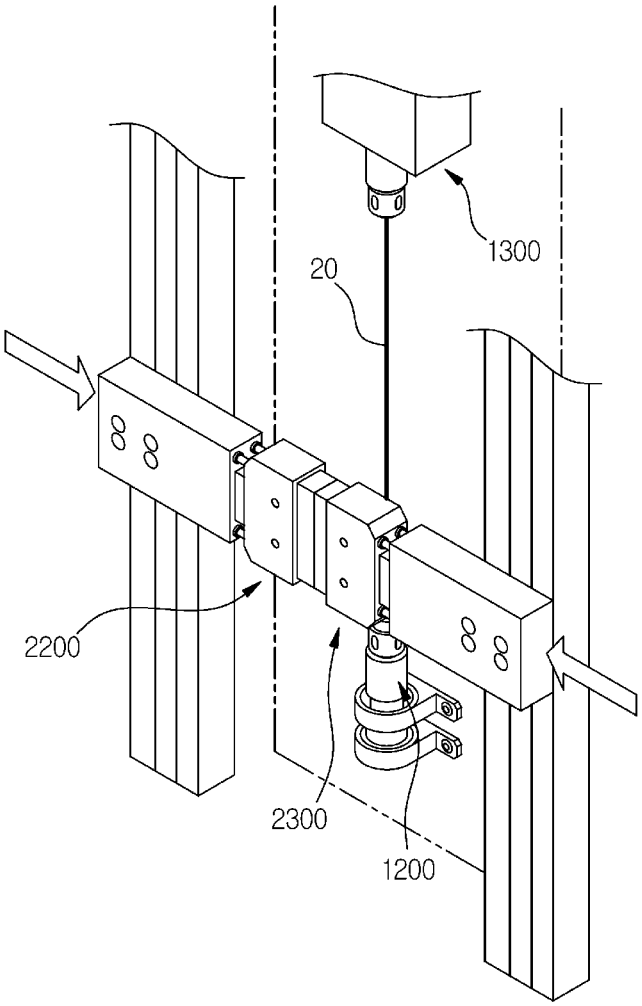
Figure 14:
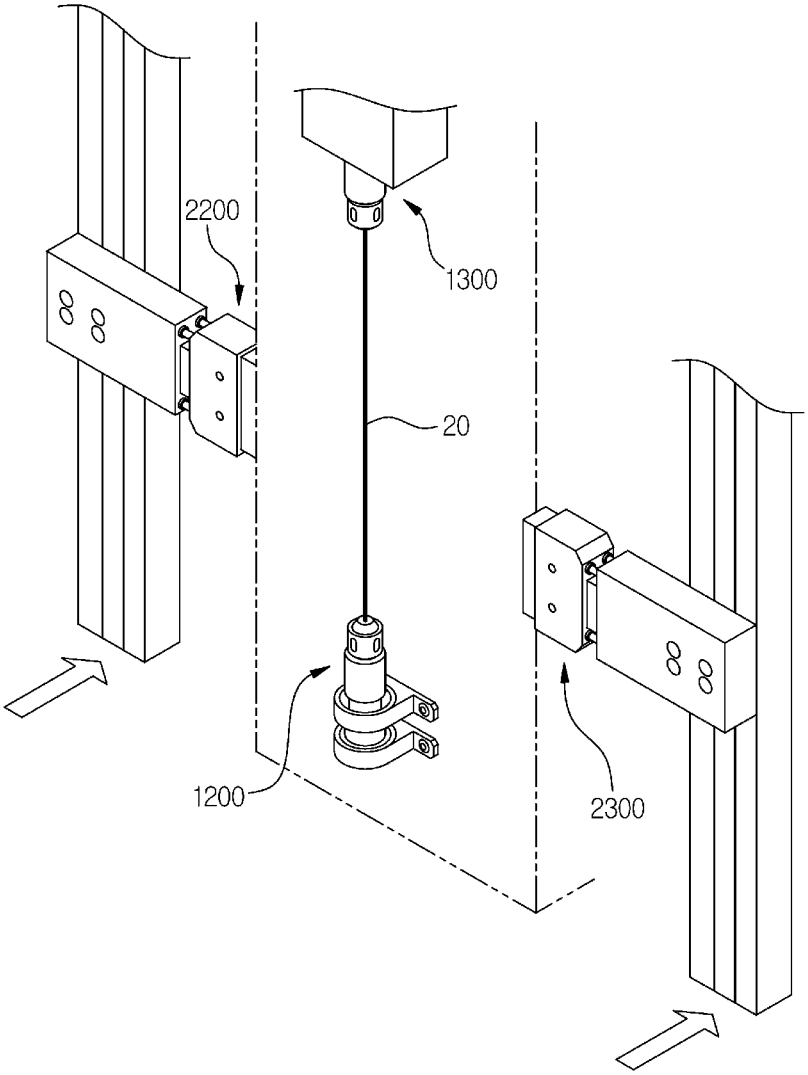

FIGS. 12 to 14 illustrate an operation of a wire coating device 10 according to an embodiment of the present disclosure.

Referring to FIG. 12, the first fiber forming module 2200 and the second fiber forming module 2300 may be disposed to face each other. A polymer solution may be applied to at least one of the first fiber forming module contact surface 2231 (see FIG. 10) and the second fiber forming module contact surface 2331 (see FIG. 10).

Referring to FIG. 13, the first fiber forming module 2200 and the second fiber forming module 2300 may approach each other. When the first fiber forming module 2200 and the second fiber forming module 2300 approach each other, the polymer solution may be positioned between the first fiber forming module 2200 and the second fiber forming module 2300.

When the first fiber forming module 2200 and the second fiber forming module 2300 are away from each other, the polymer solution between the first fiber forming module 2200 and the second fiber forming module 2300 may be converted into fiber due to viscoelasticity. The converted fiber may last from the first fiber forming module contact surface 2231 (see FIG. 10) to the second fiber forming module contact surface 2331 (see FIG. 10).

In the process in which the first fiber forming module 2200 and the second fiber forming module 2300 are away from each other, tension may be applied to the fiber forming module connection members 2240 and 2340 (see FIG. 9) due to viscosity of the polymer solution. A spring constant of the fiber forming module first connection members 2241 and 2341 may be different from a spring constant of the fiber forming module second connection members 2242 and 2342.

Accordingly, the first fiber forming module contact surface 2231 and the second fiber forming module contact surface 2331 may not be entirely away from the wire 20 at a constant distance. For example, front portions of the first fiber forming module contact surface 2231 and the second fiber forming module contact surface 2331 may be away from the wire 20 earlier or later than rear portions of the first fiber forming module contact surface 2231 and the second fiber forming module contact surface 2331. Based on such a mechanism, an amount of polymer fibers generated from the polymer solution may increase.

The process in which the first fiber forming module 2200 and the second fiber forming module 2300 approach each other and are away from each other may be repeated several times. In this process, multiple fibers may be formed between the first fiber forming module 2200 and the second fiber forming module 2300.

Referring to FIG. 14, the fiber forming modules 2200 and 2300 may move rearward. The movement module 2100 (see to FIG. 1) may move rearward. When the movement module 2100 (see FIG. 1) moves rearward, the fiber forming modules 2200 and 2300 may move rearward. When the fiber forming modules 2200 and 2300 move rearward, fibers formed between the first fiber forming module 2200 and the second fiber forming module 2300 may cross the wire 20. When the fibers cross the wire 20, the fibers may be covered or coated on the wire 20. The wire 20 may be the wire core 21 (see FIG. 11) or a state in which fibers are coated on the wire core 21 (see FIG. 11).

In the process in which the fibers cross the wire 20, the first chuck 1220 (see FIG. 2) and the second chuck 1320 (see FIG. 2) may spin. When the first chuck 1220 (see FIG. 2) and the second chuck 1320 (see FIG. 2) spin, the wire 20 may spin. When the wire 20 spins, the fibers may be effectively attached to the wire 20.

The movement module 2100 (see FIG. 1) may move forward. When the movement module 2100 (see FIG. 1) moves forward, the fiber forming modules 2200 and 2300 may move forward. When fibers are formed between the first fiber forming module 2200 and the second fiber forming module 2300, the movement module 2100 (see FIG. 1) may move rearward so that the fibers are effectively attached to the wire 20. As this process is repeated, the fibers may be covered or coated on the wire 20.

When the plurality of fiber forming module contact surfaces 2231 and 2331 (see FIG. 10) are provided, the process in which the fibers are covered or coated on the wire 20 may be considered. Referring to (b) of FIG. 10, the fiber forming module first contact surfaces 2231-1 and 2331-1, the fiber forming module recesses 2235 and 2335, and the fiber forming module second contact surfaces 2231-2 and 2331-2 may be sequentially disposed in the first direction DR1 or the front-rear direction.

After the polymer solution is applied to the fiber forming module first contact surfaces 2231-1 and 2331-1 and the fiber forming module second contact surfaces 2231-2 and 2331-2, the first fiber forming module 2200 and the second fiber forming module 2300 may approach and retreat. When the first fiber forming module 2200 and the second fiber forming module 2300 approach each other, the wire 20 may be positioned in the fiber forming module recesses 2235 and 2335. That is, even if the first fiber forming module 2200 and the second fiber forming module 2300 approach each other, the wire 20 may be spaced apart from the fiber forming modules 2200 and 2300. Front-rear direction positions of the fiber forming modules 2200 and 2300 that allow the wire 20 to be positioned in the fiber forming module recesses 2235 and 2335 may be referred to as a reference position.

After polymer component fibers are formed between the first fiber forming module 2200 and the second fiber forming module 2300, the movement module 2100 (see FIG. 1) may move forward. When the movement module 2100 (see FIG. 1) moves forward, the first fiber forming module 2200 and the second fiber forming module 2300 may move forward. When the first fiber forming module 2200 and the second fiber forming module 2300 move forward, fibers formed between the first fiber forming module second contact surface 2231-2 and the second fiber forming module second contact surface 2331-2 may cross the wire 20.

The movement module 2100 (see FIG. 1) may move rearward. When the movement module 2100 (see FIG. 1) moves rearward, the first fiber forming module 2200 and the second fiber forming module 2300 may move rearward. When the first fiber forming module 2200 and the second fiber forming module 2300 move rearward, fibers formed between the first fiber forming module first contact surface 2231-1 and the second fiber forming module first contact surface 2331-1 may cross the wire 20.

The first fiber forming module 2200 and the second fiber forming module 2300 may move forward and may be positioned at the reference position. The first fiber forming module 2200 and the second fiber forming module 2300 may generate fibers while performing the approach and retreat movement. In the process in which the first fiber forming module 2200 and the second fiber forming module 2300 move forward and then move rearward again, the fibers may be attached to the wire 20. The above process may be repeatedly performed.

Figure 15:
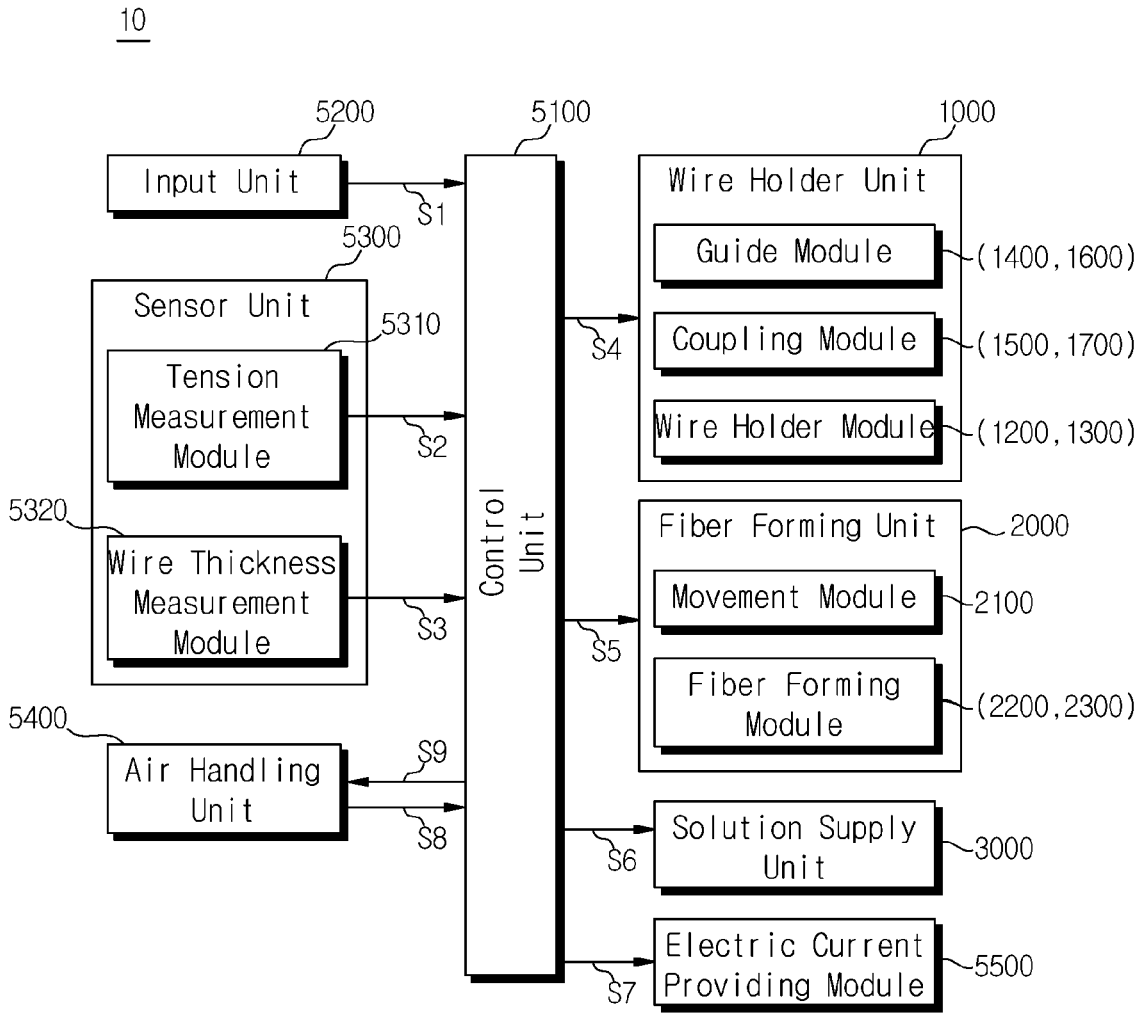
FIG. 15 illustrates a block diagram of a wire coating device 10 according to an embodiment of the present disclosure.

FIG. 15 illustrates a block diagram of a wire coating device 10 according to an embodiment of the present disclosure. FIG. 15 will be described along with FIGS. 1 to 14.

Referring to FIGS. 1 to 15, the wire coating device 10 may include an air handling unit 5400. The air handling unit 5400 may measure and adjust a temperature and humidity of an air inside the casing unit 4000.

The wire coating device 10 may include an electric current providing module 5500. The electric current providing module 5500 may provide an electric current to the wire 20 coupled to the first wire holder module 1200 and the second wire holder module 1300. When an electric current is applied to the wire 20 coated with the polymer fiber, the wire covering portion 22 can be effectively attached to the wire core 21 by the electric current flowing in the wire core 21. The process of providing the electric current to the wire 20 may be performed after the wire covering portion 22 is formed on the wire 20.

The wire coating device 10 may include an input unit 5200. The input unit 5200 may be implemented in the shape of the touch screen 5200. The input unit 5200 may generate a first signal S1. The input unit 5200 may transmit the first signal S1 to the control unit 5100. The first signal S1 may include command information about the operation of the wire coating device 10.

The wire coating device 10 may include a sensor unit 5300. The sensor unit 5300 may include a tension measurement module 5310. The tension measurement module 5310 may include, for example, a load cell. The tension measurement module 5310 may measure a tension formed in the wire 20 coupled to the first wire holder module 1200 and the second wire holder module 1300. The tension measurement module 5310 may be installed or disposed on at least one of the first wire holder module 1200 and the second wire holder module 1300.

The sensor unit 5300 may generate a second signal S2. The second signal S2 may include information on the tension formed in the wire 20 coupled to the first wire holder module 1200 and the second wire holder module 1300. The second signal S2 may be transmitted to the control unit 5100.

The sensor unit 5300 may include a wire thickness measurement module 5320. The wire thickness measurement module 5320 may be installed or disposed on the holder body 1100. The wire thickness measurement module 5320 may include, for example, an optical device or an ultrasonic device. The wire thickness measurement module 5320 may measure a thickness of the wire 20 coupled to the first wire holder module 1200 and the second wire holder module 1300.

The sensor unit 5300 may generate a third signal S3. The third signal S3 may include information on the thickness of the wire 20 coupled to the first wire holder module 1200 and the second wire holder module 1300. The third signal S3 may be transmitted to the control unit 5100.

The input signals S1, S2 and S3 may include at least one of the first signal S1, the second signal S2, and the third signal S3. The control unit 5100 may generate output signals S4, S5, S6 and S7 based on the input signals S1, S2 and S3. The output signals S4, S5, S6 and S7 may include command information about the operation of the wire coating device 10. The output signals S4, S5, S6 and S7 may include at least one of a fourth signal S4, a fifth signal S5, a sixth signal S6, and a seventh signal S7.

The fourth signal S4 may be transmitted to the wire holder unit 1000. The fourth signal S4 may include command information about the operation of the wire holder unit 1000. For example, the fourth signal S4 may include command information about the spin of the first chuck 1220 and the second chuck 1320. For example, the fourth signal S4 may include command information about the operation of the guide modules 1400 and 1600. For example, the fourth signal S4 may include command information about the operation of the coupling modules 1500 and 1700. For example, the wire holder modules 1200 and 1300 receiving the fourth signal S4 may increase or reduce the tension formed in the wire 20.

The fifth signal S5 may be transmitted to the fiber forming unit 2000. For example, the fifth signal S5 may include command information about the movement of the movement module 2100. For example, the fifth signal S5 may include command information about the operation of the fiber forming modules 2200 and 2300.

The sixth signal S6 may be transmitted to the solution supply unit 3000. For example, the sixth signal S6 may include command information about the operation of the solution supply driver 3300.

The seventh signal S7 may be transmitted to the electric current providing module 5500. The seventh signal S7 may include command information about the operation of the electric current providing module 5500. For example, the seventh signal S7 may be transmitted to the electric current providing module 5500 after the wire covering portion 22 is formed in the wire 20.

An eighth signal S8 may be generated by the air handling unit 5400. The eighth signal S8 may include information about the temperature and humidity of the air inside the casing unit 4000. The eighth signal S8 may be transmitted to the control unit 5100.

The control unit 5100 may generate a ninth signal S9 based on the eighth signal S8 generated by the air handling unit 5400. The ninth signal S9 may include command information about the operation of the air handling unit 5400. The air handling unit 5400 may adjust the temperature and humidity of the air inside the casing unit 4000 in response to the ninth signal S9.

The control unit 5100 may be electrically connected to the input unit 5200, the sensor unit 5300, the air handling unit 5400, the electric current providing module 5500, the wire holder unit 1000, the fiber forming unit 2000, and the solution supply unit 3000.

Figure 16:
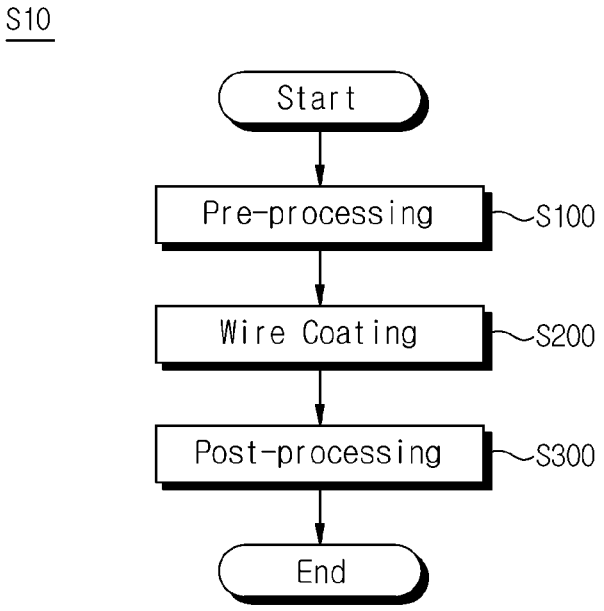
FIG. 16 is a flow chart illustrating a wire coating method S10 according to an embodiment of the present disclosure.

FIG. 16 is a flow chart illustrating a wire coating method S10 according to an embodiment of the present disclosure. FIG. 16 will be described along with FIGS. 1 to 15.

Referring to FIGS. 1 to 16, the wire coating method S10 may include a pre-processing step S100. In the pre-processing step S100, the wire core 21 is processed, and a polymer solution may be manufactured.

The wire coating method S10 may include a wire coating step S200. In the wire coating step S200, polymer fibers may be formed of the polymer solution, and the polymer fibers may be attached to the wire core 21 and may be covered or coated on the wire core 21.

The wire coating method S10 may a post-processing step S300. In the post-processing step S300, a state in which the wire covering portion 22 is adsorbed to the wire core 21 may be improved.

Figure 17:
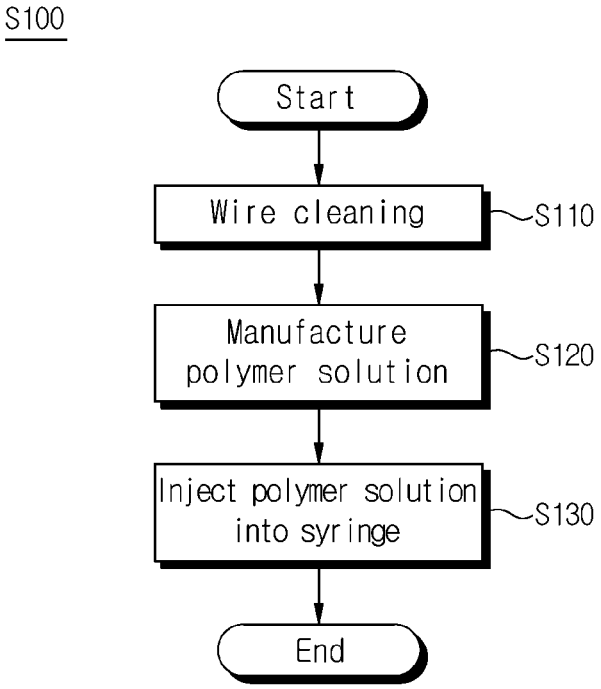
FIG. 17 is a flow chart illustrating a pre-processing step S100 according to an embodiment of the present disclosure.

FIG. 17 is a flow chart illustrating a pre-processing step S100 according to an embodiment of the present disclosure. FIG. 17 will be described along with FIGS. 1 to 16.

Referring to FIGS. 1 to 17, the pre-processing step S100 may include a wire cleaning step S110. In the wire cleaning step S110, the wire core 21 may be cleaned by, for example, an ultrasonic cleaner.

The pre-processing step S100 may include a polymer solution manufacturing step S120. In this step S120, the polymer solution may be prepared by inserting, for example, a polymer powder aqueous solution (30 to 50%) into a centrifugal mixer. The molecular weight of polymer powder used in the polymer solution may be, for example, 2,000 kDa or more. A polymer material, a solvent, and an inorganic material used in the polymer solution are as described above.

The pre-processing step S100 may include a step S130 of injecting a polymer solution into a syringe. In this step S130, the polymer solution may be injected into the solution supply syringe 3200. It is recommended that the polymer solution injected into the solution supply syringe 3200 be used within three days. The step S130 may be performed after the polymer solution manufacturing step S120.

The wire cleaning step S110 may be performed in parallel with (or individually from) the polymer solution manufacturing step S120 and/or the syringe injecting step S130.

Figure 18:
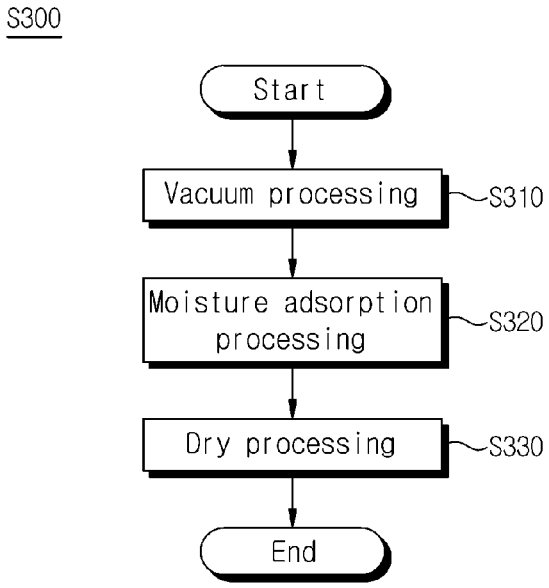
FIG. 18 is a flow chart illustrating a post-processing step S300 according to an embodiment of the present disclosure.

FIG. 18 is a flow chart illustrating a post-processing step S300 according to an embodiment of the present disclosure. FIG. 18 will be described along with FIGS. 1 to 17.

Referring to FIGS. 1 to 18, the post-processing step S300 may include a vacuum processing step S310. In the vacuum processing step S310, the "coated wire" may be in a vacuum state. The "vacuum state" may indicate a state in which a pressure is lower than an atmospheric pressure. In the vacuum processing step S310, coating uniformity may increase. The coating uniformity may indicate how uniform the thickness of the wire covering portion 22 distributed on the wire core 21 is.

The post-processing step S300 may include a moisture adsorption processing step S320. The step S320 may be performed after the vacuum processing step S310. In this step S320, the coated wire 20 may be in a humidity environment of 50% or more. In this step S320, a degree to which the wire covering portion 22 is adsorbed to the wire core 21 may be increased.

The post-processing step S300 may include a dry processing step S330. The dry processing step S330 may be performed after the moisture adsorption processing step S320. In this step S330, the coated wire 20 may be dried. In this step S330, the moisture of the coated wire 20 may be removed.

The wire covering portion 22 may be changed while going through the post-processing step S300. For example, the wire covering portion 22 may be divided into two layers after going through the post-processing step S300. The layer contacting the wire core 21 among the two layers of the wire covering portion 22 may be referred to as "a fiber network coating layer" or "an inside coating layer". The layer that surrounds the fiber network coating layer and is exposed to the outside among the two layers of the wire covering portion 22 may be referred to as "a gel coating layer" or "an outside coating layer".

The wire covering portion 22 of the coated wire 20 that goes through the wire coating step S200 and does not go through the post-processing step S300 may form one layer, for example, a fiber network coating layer. If the coated wire 20 goes through the post-processing step S300, a fiber structure constituting an outer portion of the wire covering portion 22 may be changed to form an outside coating layer. An outer surface of the outside coating layer may be more uniform.

Figure 19:
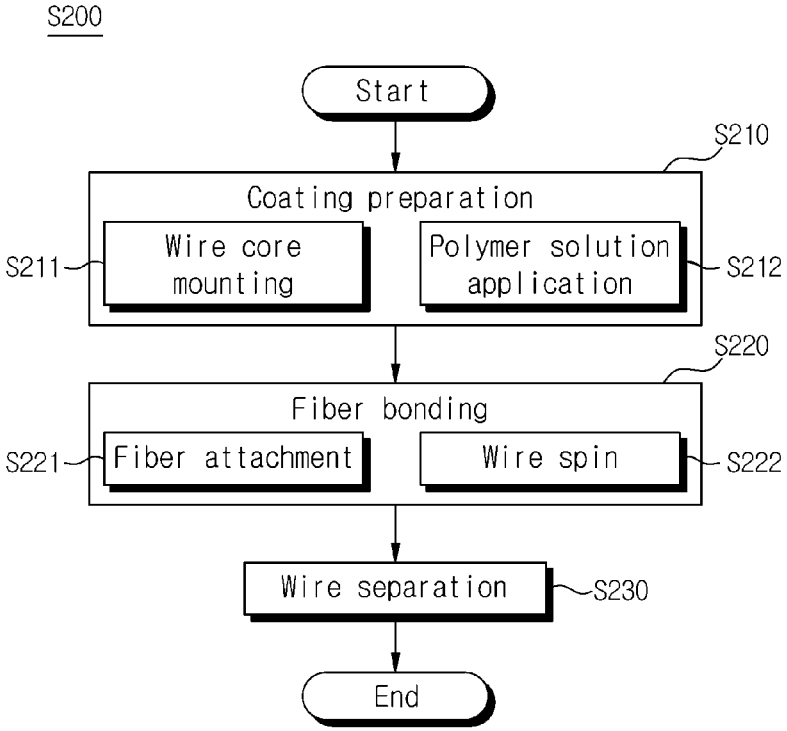
FIG. 19 is a flow chart illustrating a wire coating step S200 according to an embodiment of the present disclosure.

FIG. 19 is a flow chart illustrating a wire coating step S200 according to an embodiment of the present disclosure. FIG. 19 will be described along with FIGS. 1 to 18. The wire coating step S200 may be performed using the wire coating device 10 according to an embodiment of the present disclosure. However, the scope of the present disclosure regarding the wire coating step S200 is not limited to the wire coating device 10.

Referring to FIGS. 1 to 19, the wire coating step S200 may include a coating preparation step S210. In the coating preparation step S210, the wire core 21 may be mounted on the wire holder modules 1200 and 1300. In the coating preparation step S210, the polymer solution may be discharged from the solution supply syringe 3200 and applied to the fiber forming module contact surfaces 2231 and 2331.

The coating preparation step S210 may include a wire core mounting step S211. In this step S211, the wire core 21 may be guided to the chucks 1220 and 1320 by the guide modules 1400 and 1600 and may be coupled to the chucks 1220 and 1320 by the coupling modules 1500 and 1700.

The coating preparation step S210 may include a polymer solution application step S212. In the polymer solution application step S212, when the movement module 2100 operates, the fiber forming module contact surfaces 2231 and 2331 may approach the solution supply syringe 3200. After the fiber forming module contact surfaces 2231 and 2331 approach the solution supply syringe 3200, the solution supply driver 3300 may operate such that the polymer solution may be applied to the fiber forming module contact surfaces 2231 and 2331. While the solution supply driver 3300 operates, the movement module 2100 may change the positions of the fiber forming module contact surfaces 2231 and 2331. Hence, the polymer solution may be evenly applied to the fiber forming module contact surfaces 2231 and 2331.

The wire coating step S200 may include a fiber bonding step S220. In the fiber bonding step S220, polymer fibers formed of the polymer solution may be attached to the wire core 21 or the wire 20. In the fiber bonding step S220, the wire 20 may spin. A spin axis of the wire 20 may be parallel to the longitudinal direction of the wire 20 or the third direction DR3.

The fiber bonding step S220 may include a fiber attachment step S221. In the fiber attachment step S221, the fiber forming modules 2200 and 2300 may move rearward. When the fiber forming modules 2200 and 2300 move rearward, the polymer fibers and the wire 20 may cross each other. In the process in which the polymer fibers and the wire 20 cross each other, the polymer fibers may be attached to the wire 20.

In the fiber attachment step S221, in the embodiment illustrated in (b) of FIG. 10, the fiber forming modules 2200 and 2300 may move forward and then move rearward again. When the fiber forming modules 2200 and 2300 move forward, the polymer fibers formed on the fiber forming module second contact surfaces 2231-2 and 2331-2 may cross the wire 20. When the fiber forming modules 2200 and 2300 move further back than the reference position, the polymer fibers formed on the fiber forming module first contact surfaces 2231-1 and 2331-1 may cross the wire 20.

The fiber bonding step S220 may include a wire spin step S222. In the wire spin step S222, the chucks 1220 and 1320 may spin. The spin axis of the chucks 1220 and 1320 may be parallel to the longitudinal direction of the chucks 1220 and 1320. When the chucks 1220 and 1320 spin, the wire 20 may spin around the spin axis of the chucks 1220 and 1320. When the wire 20 spins around the spin axis of the chucks 1220 and 1320, the polymer fibers attached to the wire 20 can be easily bonded to the wire 20.

The wire coating step S200 may include a wire separation step S230. The wire separation step S230 may be a reverse process to the wire core mounting step S211. In the wire separation step S230, the coated wire 20 may be separated from the chucks 1220 and 1320 by the coupling modules 1500 and 1700.

The wire coating step S200 may include an "electric current providing step". The electric current providing step may be performed between the fiber bonding step S220 and the wire separation step S230. In the electric current providing step, electric current may be provided to the wire core 21. By providing the electric current to the wire core 21, the wire covering portion 22 can be effectively adsorbed to the wire core 21. The electric current provided to the wire core 21 may include at least one of, for example, direct current (DC), pulse-current, and alternating current (AC).

Figure 20:
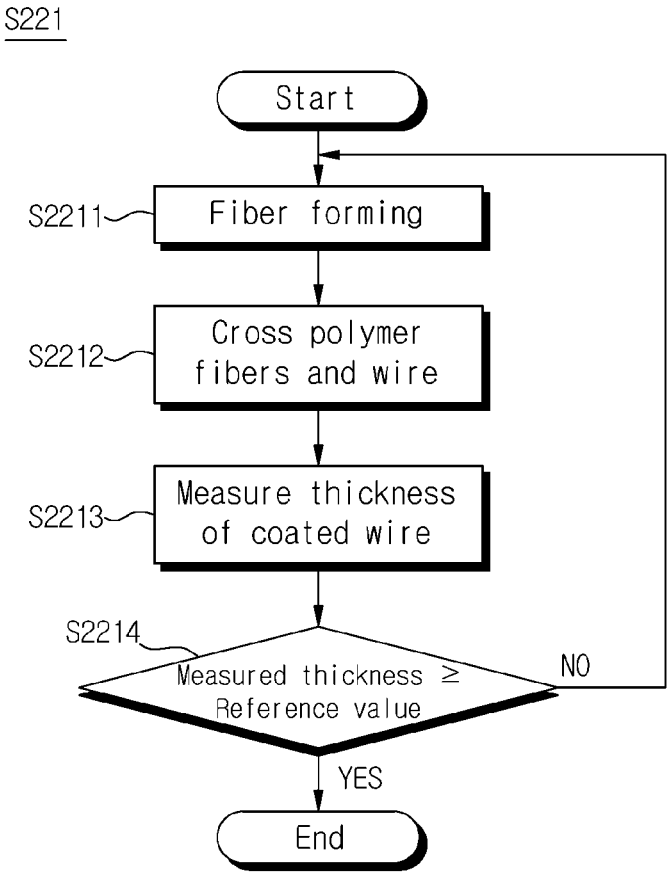
FIG. 20 is a flow chart illustrating a fiber attaching step S221 according to an embodiment of the present disclosure.

FIG. 20 is a flow chart illustrating a fiber attaching step S221 according to an embodiment of the present disclosure. FIG. 20 will be described along with FIGS. 1 to 19.

Referring to FIGS. 1 to 20, the fiber attachment step S221 may include a fiber forming step S2211. In the fiber forming step S2211, the polymer solution applied to the fiber forming module contact surfaces 2231 and 2331 may be stretched and converted into polymer fibers. In the fiber forming step S2211, the first fiber forming module 2200 and the second fiber forming module 2300 may approach each other and retreat from each other. In this process, polymer fibers may be formed between the first fiber forming module contact surface 2231 and the second fiber forming module contact surface 2331. The formed polymer fibers may extend from the first fiber forming module contact surface 2231 and last to the second fiber forming module contact surface 2331.

The fiber attachment step S221 may include a step S2212 of crossing the polymer fibers and the wire 20. This step S2212 may be referred to as "cross step S2212". In this step S2212, at least one of the polymer fibers and the wire 20 may move. For example, in this step S2212, as the movement module 2100 moves, the polymer fibers may move toward the wire 20 and cross the wire 20.

In the step S2212 in which the polymer fibers and the wire 20 cross each other, in the embodiment illustrated in (a) of FIG. 10, when the fiber forming modules 2200 and 2300 move rearward, the polymer fibers and the wire 20 may cross each other.

In the step S2212 in which the polymer fibers and the wire 20 cross each other, in the embodiment illustrated in (b) of FIG. 10, when the fiber forming modules 2200 and 2300 move forward, the polymer fibers formed on the fiber forming module second contact surfaces 2231-2 and 2331-2 may cross the wire 20. When the fiber forming modules 2200 and 2300 move further back than the reference position, the polymer fibers formed on the fiber forming module first contact surfaces 2231-1 and 2331-1 may cross the wire 20.

The fiber attachment step S221 may include a step S2213 of measuring a thickness of the coated wire 20. In this step S2213, the wire thickness measurement module 5320 may measure the thickness of the wire 20 coupled to the first wire holder module 1200 and the second wire holder module 1300. This step S2213 may be referred to as a "wire thickness measurement step S2213". The thickness of the wire 20 may indicate a diameter of the wire 20. The diameter of the wire 20 may indicate an outer diameter of the wire 20.

The fiber attachment step S221 may include a step S2214 of comparing the thickness of the wire 20 with a reference value. In this step S2214, the control unit 5100 may determine whether the thickness of the wire 20 is equal to or greater than the reference value based on the third signal S3.

When it is determined that the thickness of the wire 20 is equal to or greater than the reference value, the control unit 5100 may end the fiber attachment step S221. When it is determined that the thickness of the wire 20 is less than the reference value, the control unit 5100 may perform the fiber forming step S2211.

Some embodiments or other embodiments of the present disclosure described above are not mutually exclusive or distinct from each other. Configurations or functions of some embodiments or other embodiments of the present disclosure described above can be used together or combined with each other.

It is apparent to those skilled in the art that the present disclosure can be embodied in other specific forms without departing from the spirit and essential features of the present disclosure. Accordingly, the aforementioned detailed description should not be construed as limiting in all aspects and should be considered as illustrative. The scope of the present disclosure should be determined by rational interpretation of the appended claims, and all modifications within an equivalent scope of the present disclosure are included in the scope of the present disclosure.

What is claimed is:

1. A wire coating device comprising:

a wire holder unit, fixing a first end and a second end of a wire;

a fiber forming unit, including a first fiber forming module and a second fiber forming module that receive a polymer solution, face each other, and form fibers while approaching each other and retreating from each other; and a control unit configured to adjust a tension of the wire by controlling the wire holder unit and cross the wire and the fibers by controlling the fiber forming unit, wherein the fibers are attached and coated on the wire when the wire and the fibers cross each other, wherein the wire holder unit includes:

a holder body, a front surface of the holder body including a first opening, a second opening and a third opening a first wire holder module including a first wire holder frame coupled to a front surface of the holder body, and a first chuck rotatably coupled to the first wire holder frame and coupled to the first end of the wire, the first chuck including a first chuck body coupled to the first wire holder frame where the first chuck body spins in the first wire holder frame; and a second wire holder module including a second wire holder frame that is positioned in the third opening formed in the front surface of the holder body and is movable in the third opening, and a second chuck rotatably coupled to the second wire holder frame and coupled to the second end of the wire, the second chuck being configured to face the first chuck, and the second chuck comprising a substantially same structure as the first chuck; and wherein the first chuck and second chuck spins the wire about an axis of the wire extending in a longitudinal direction.

2. The wire coating device of claim 1, wherein the first opening and the second opening are positioned between the first wire holder frame and the third opening, wherein the first opening is adjacent to the first wire holder frame, wherein the second opening is adjacent to the third opening, wherein the wire holder unit further includes:

a first guide module which is adjacent to the first chuck when the first guide module is withdrawn forward from the first opening, and guides the wire to the first chuck; and a second guide module which is adjacent to the second chuck when the second guide module is withdrawn forward from the second opening, and guides the wire to the second chuck.

3. The wire coating device of claim 1, wherein the first opening and the second opening are positioned between the first wire holder frame and the third opening, wherein the first opening is adjacent to the first wire holder frame, wherein the second opening is adjacent to the third opening, wherein the wire holder unit further includes:

a first coupling module that is coupled to the first chuck when the first coupling module is withdrawn forward from the first opening, and is separated from the first chuck when the first coupling module is retracted rearward; and a second coupling module that is coupled to the second chuck when the second coupling module is withdrawn forward from the second opening, and is separated from the second chuck when the second coupling module is retracted rearward.

4. The wire coating device of claim 3, wherein when the first chuck spins in a state in which the first chuck and the first coupling module are coupled, the wire is fixed to the first chuck, wherein when the second chuck spins in a state in which the second chuck and the second coupling module are coupled, the wire is fixed to the second chuck.

5. The wire coating device of claim 1, further comprising a casing unit accommodating the wire holder unit and the fiber forming unit, wherein the fiber forming unit includes a movement module which is mounted with the first fiber forming module and the second fiber forming module and is movably installed in the casing unit.

6. The wire coating device of claim 1, wherein the first fiber forming module includes a first fiber forming module contact member having a first fiber forming module contact surface facing the second fiber forming module, wherein the second fiber forming module includes a second fiber forming module contact member having a second fiber forming module contact surface facing the first fiber forming module, wherein at least one of the first fiber forming module contact surface and the second fiber forming module contact surface has wrinkles formed thereon.

7. The wire coating device of claim 1, wherein the first fiber forming module includes a first fiber forming module contact member having a first fiber forming module contact surface facing the second fiber forming module, wherein the second fiber forming module includes a second fiber forming module contact member having a second fiber forming module contact surface facing the first fiber forming module, wherein at least one of the first fiber forming module contact surface and the second fiber forming module contact surface includes:

a fiber forming module first contact surface and a fiber forming module second contact surface that are disposed in a front-rear direction and are spaced apart from each other; and a fiber forming module recess that is positioned between the fiber forming module first contact surface and the fiber forming module second contact surface and is concavely formed.

8. The wire coating device of claim 1, further comprising a tension measurement module measuring a tension formed in the wire fixed to the wire holder unit.

9. The wire coating device of claim 1, further comprising a wire thickness measurement module measuring a thickness of the wire.

10. The wire coating device of claim 1, further comprising an electric current providing module providing an electric current to the wire after the fibers are coated on the wire.

11. The wire coating device of claim 1, wherein the wire includes:

a wire core and a wire covering portion on which the fibers attach to the wire core, wherein the wire core is flexible, wherein the wire covering portion is water-soluble.

* * * * *